US012539952B2

(12) United States Patent
Groeschel et al.

(10) Patent No.: US 12,539,952 B2
(45) Date of Patent: Feb. 3, 2026

(54) MARINE DRIVES HAVING HYDRAULICALLY ACTUATED STEERABLE GEARCASE

(71) Applicant: Brunswick Corporation, Mettawa, IL (US)

(72) Inventors: John A. Groeschel, Theresa, WI (US); Ryan A. Fergus, Neenah, WI (US)

(73) Assignee: Brunswick Corporation, Mettawa, IL (US)

( * ) Notice: Subject to any disclaimer, the term of this patent is extended or adjusted under 35 U.S.C. 154(b) by 435 days.

(21) Appl. No.: 18/120,506

(22) Filed: Mar. 13, 2023

(65) Prior Publication Data

US 2023/0303228 A1 Sep. 28, 2023

Related U.S. Application Data

(60) Provisional application No. 63/324,251, filed on Mar. 28, 2022.

(51) Int. Cl.
*B63H 20/12* (2006.01)
*B63H 20/32* (2006.01)

(52) U.S. Cl.
CPC ..... *B63H 20/12* (2013.01); *B63H 2020/323* (2013.01)

(58) Field of Classification Search
CPC ..... B63H 20/12; B63H 2020/323
See application file for complete search history.

(56) References Cited

U.S. PATENT DOCUMENTS

| | | | |
|---|---|---|---|
| 1,161,935 | A | 11/1915 | Heck |
| 1,774,956 | A | 9/1930 | Wilson |
| 2,372,247 | A | 3/1945 | Pemberton |
| 2,384,436 | A | 9/1945 | Bossen |
| 2,536,894 | A | 1/1951 | Wanzer |
| 2,549,481 | A | 4/1951 | Kiekhaefer |
| 2,688,299 | A | 9/1954 | Gload et al. |
| 2,732,819 | A | 1/1956 | Irgens |

(Continued)

FOREIGN PATENT DOCUMENTS

| | | |
|---|---|---|
| CA | 1317165 | 5/1993 |
| CN | 101475050 | 7/2009 |

(Continued)

OTHER PUBLICATIONS

Murray, Charles J., Boat drive Increases Usable Onboard Space: Outboard Motor is Mounted Inboard, Reprinted from Design News, Mar. 1989, United States.

(Continued)

*Primary Examiner* — Evan P Dzierzynski
(74) *Attorney, Agent, or Firm* — Andrus Intellectual Property Law, LLP

(57) ABSTRACT

A marine drive is for propelling a marine vessel. The marine drive has a drive assembly configured to support a propulsor for generating a thrust force in water, the drive assembly comprising a driveshaft housing and a gearcase suspended from the driveshaft housing, wherein the drive assembly is trimmable relative to the marine vessel about a trim joint, a steering actuator configured to steer the gearcase relative to the driveshaft housing, and a pump configured to pump a hydraulic fluid to and/or from the steering actuator via the trim joint.

20 Claims, 28 Drawing Sheets

(56) References Cited

U.S. PATENT DOCUMENTS

| | | | |
|---|---|---|---|
| 2,804,838 | A | 9/1957 | Moser |
| 2,877,733 | A | 3/1959 | Harris |
| 2,902,967 | A | 9/1959 | Wanzer |
| 3,021,725 | A | 2/1962 | Schneider |
| 3,084,657 | A | 4/1963 | Kiekhaefer |
| 3,094,967 | A | 6/1963 | Willis |
| 3,164,122 | A | 1/1965 | Morris |
| 3,171,382 | A | 3/1965 | Bergstedt |
| 3,285,221 | A | 11/1966 | North |
| 3,310,021 | A | 3/1967 | Shimanckas |
| 3,376,842 | A | 4/1968 | Wynne |
| 3,404,586 | A | 10/1968 | Fanstone |
| 3,483,843 | A | 12/1969 | Hawthorne |
| 3,486,478 | A | 12/1969 | Halliday |
| 3,548,775 | A | 12/1970 | Hammond et al. |
| 3,707,939 | A | 1/1973 | Berg |
| 3,738,306 | A | 6/1973 | Pinkerton |
| 3,756,188 | A | 9/1973 | Smith |
| 3,795,219 | A | 3/1974 | Peterson |
| 3,841,257 | A | 10/1974 | Strang |
| 3,881,443 | A | 5/1975 | Hump |
| 3,896,757 | A | 7/1975 | Kucher |
| 3,930,436 | A | 1/1976 | Hedenberg |
| 3,946,698 | A | 3/1976 | LaFollette et al. |
| 3,982,496 | A | 9/1976 | Blanchard |
| 4,276,034 | A | 6/1981 | Kashmerick |
| 4,297,097 | A | 10/1981 | Kiekhaefer |
| 4,323,354 | A | 4/1982 | Blanchard |
| 4,343,612 | A | 8/1982 | Blanchard |
| 4,371,348 | A | 2/1983 | Blanchard |
| 4,418,633 | A | 12/1983 | Krautkremer et al. |
| 4,432,737 | A | 2/1984 | Johansson |
| 4,619,548 | A | 10/1986 | Kazaoka et al. |
| 4,668,195 | A | 5/1987 | Smith |
| 4,747,795 | A | 5/1988 | Kawamura et al. |
| 4,887,982 | A | 12/1989 | Newman et al. |
| 4,907,994 | A | 3/1990 | Jones |
| 4,911,666 | A | 3/1990 | Gage et al. |
| 4,932,907 | A | 6/1990 | Newman et al. |
| 5,024,639 | A | 6/1991 | Crispo |
| 5,108,325 | A | 4/1992 | Livingston et al. |
| 5,112,256 | A | 5/1992 | Clement |
| 5,224,888 | A | 7/1993 | Fujimoto et al. |
| 5,280,708 | A | 1/1994 | Sougawa et al. |
| 5,463,990 | A | 11/1995 | Rush, II et al. |
| 5,465,633 | A | 11/1995 | Bernloehr |
| 5,480,330 | A | 1/1996 | Brown |
| 5,487,687 | A | 1/1996 | Idzikowski et al. |
| 5,522,744 | A | 6/1996 | Schlogel |
| 5,540,606 | A | 7/1996 | Strayhorn |
| 5,660,571 | A | 8/1997 | Nakayasu et al. |
| 5,674,099 | A | 10/1997 | Muramatsu et al. |
| 5,711,742 | A | 1/1998 | Leinonen et al. |
| 5,743,774 | A | 4/1998 | Adachi et al. |
| 6,146,220 | A | 11/2000 | Alby et al. |
| 6,183,321 | B1 | 2/2001 | Alby et al. |
| 6,273,771 | B1 | 8/2001 | Buckley et al. |
| 6,276,977 | B1 | 8/2001 | Treinen et al. |
| 6,286,845 | B1 | 9/2001 | Lin |
| 6,287,159 | B1 | 9/2001 | Polakowski et al. |
| 6,346,017 | B1 | 2/2002 | Silorey |
| 6,402,577 | B1 | 6/2002 | Treinen et al. |
| 6,431,928 | B1 | 8/2002 | Aarnivuo |
| 6,497,594 | B1 | 12/2002 | Towner |
| 6,497,597 | B2 | 12/2002 | Mccarthy |
| 6,544,085 | B1 | 4/2003 | Menard et al. |
| 6,554,083 | B1 | 4/2003 | Kerstetter |
| 6,561,859 | B1 | 5/2003 | Towner |
| 6,609,939 | B1 | 8/2003 | Towner et al. |
| 7,163,427 | B1 | 1/2007 | Lee |
| 7,244,152 | B1 | 7/2007 | Uppgard |
| 7,267,587 | B2 | 9/2007 | Oguma et al. |
| 7,290,638 | B2 | 11/2007 | Shiino et al. |
| 7,347,753 | B1 | 3/2008 | Caldwell et al. |
| 7,387,556 | B1 | 6/2008 | Davis |
| 7,517,262 | B2 | 4/2009 | Mizutani |
| 7,527,537 | B2 | 5/2009 | Mizutani |
| 7,588,473 | B2 | 9/2009 | Beachy Head |
| 7,641,527 | B1 | 1/2010 | Balaji et al. |
| 7,662,005 | B2 | 2/2010 | Provost |
| 7,699,674 | B1 | 4/2010 | Wald et al. |
| 7,794,295 | B2 | 9/2010 | Beachy Head |
| 7,871,302 | B2 | 1/2011 | Provost |
| 7,886,678 | B2 | 2/2011 | Mizutani |
| 7,896,304 | B1 | 3/2011 | Eichinger et al. |
| 8,118,630 | B2 | 2/2012 | Konakawa et al. |
| 8,118,701 | B2 | 2/2012 | Okabe et al. |
| 8,142,247 | B2 | 3/2012 | Konakawa et al. |
| 8,157,694 | B2 | 4/2012 | Nakamura et al. |
| 8,246,398 | B2 | 8/2012 | Inaba |
| 8,246,399 | B2 | 8/2012 | Inaba |
| 8,327,789 | B2 | 12/2012 | Emch |
| 8,425,373 | B2 | 4/2013 | Okabe et al. |
| 8,485,854 | B2 | 7/2013 | Gallato et al. |
| 8,651,904 | B2 | 2/2014 | Pellegrinetti et al. |
| 8,690,616 | B2 | 4/2014 | Grassi et al. |
| 8,715,021 | B2 | 5/2014 | Horkko et al. |
| 8,795,011 | B2 | 8/2014 | Takase et al. |
| 8,808,045 | B2 | 8/2014 | Lundqvist et al. |
| 8,821,140 | B2 | 9/2014 | Paval |
| 9,205,906 | B1 | 12/2015 | Eichinger |
| 9,233,743 | B2 | 1/2016 | Daikoku et al. |
| 9,296,458 | B2 | 3/2016 | Saruwatari et al. |
| 9,334,034 | B1 | 5/2016 | Waldvogel et al. |
| 9,446,828 | B1 | 9/2016 | Groeschel et al. |
| 9,475,560 | B1 * | 10/2016 | Jaszewski ..... B63H 20/32 |
| 9,771,137 | B1 * | 9/2017 | Gable ..... B63H 20/12 |
| 9,776,700 | B2 | 10/2017 | Beachy Head |
| 9,809,289 | B2 | 11/2017 | Nutt et al. |
| 9,849,957 | B1 | 12/2017 | Grahl et al. |
| 9,896,175 | B2 | 2/2018 | Galleta, Jr. |
| 10,215,278 | B1 | 2/2019 | Techscherer et al. |
| 10,315,747 | B1 | 6/2019 | Jaszewski et al. |
| 10,392,091 | B2 | 8/2019 | Galletta, Jr. |
| 10,518,858 | B1 | 12/2019 | Klawitter et al. |
| 10,752,328 | B1 | 8/2020 | Bielefeld et al. |
| 10,800,502 | B1 * | 10/2020 | Alby ..... B63H 20/28 |
| 11,068,297 | B2 | 7/2021 | Galletta, Jr. |
| 11,111,849 | B1 * | 9/2021 | Poirier ..... B63H 5/10 |
| 11,130,554 | B1 | 9/2021 | Alby et al. |
| 11,292,568 | B2 | 4/2022 | Galletta, Jr. |
| 2005/0282448 | A1 * | 12/2005 | Tawa ..... B63H 20/12 440/61 S |
| 2007/0004294 | A1 | 1/2007 | Mansfield et al. |
| 2013/0045648 | A1 | 2/2013 | Kinpara et al. |
| 2021/0339839 | A1 | 11/2021 | Galletta, Jr. |

FOREIGN PATENT DOCUMENTS

| | | |
|---|---|---|
| GB | 364207 | 1/1932 |
| JP | 6004958 | 10/2016 |
| WO | WO 2007020906 | 2/2007 |
| WO | WO 2017223240 | 12/2017 |

OTHER PUBLICATIONS

Extended European Search Report for EP 23164747.0 dated Aug. 30, 2023.

Extended European Search Report for European Patent Application No. 23 164754.6, dated Sep. 19, 2023.

NTN Overview & CVJ Technology, Prepared for Mercury Marine on Aug. 7, 2018. www.ntnamericas.com.

Manual for Mercury Marine Vazer Trim Cylinder, Manual ID 90-869267, published Apr. 2007.

NTN, Tri-Ball Joint, Constant Velocity Joints (Small and Medium size). CAT. No. 5602-V/E. Available online from URL: https://www.ntnglobal.com/en/products/catalog/en/5602/index.html, Published 2013.

NTN, Constant Velocity Joints for Industrial Machines: Application Examples. CAT.No. 5604/E. Available online from URL: https://www.ntnglobal.com/en/products/catalog/en/5602/index.html, Published 2005.

(56) References Cited

OTHER PUBLICATIONS

NTN, Constant Velocity Joints for industrial machines. CAT. No. 5603-V/E. Available online from URL: https://www.ntnglobal.com/en/products/catalog/en/5602/index.html, Published 2019.

* cited by examiner

MARINE DRIVES HAVING HYDRAULICALLY ACTUATED STEERABLE GEARCASE

CROSS REFERENCE TO RELATED APPLICATION

This application claims priority to U.S. Provisional Application No. 63/324,251, filed Mar. 28, 2022, which is incorporated herein by reference in its entirety.

FIELD

The present disclosure relates to marine drives, and in particular marine drives having a hydraulically actuated steerable gearcase.

BACKGROUND

The following U.S. Patent is incorporated herein by reference in entirety.

U.S. Pat. No. 10,800,502 discloses an outboard motor having a powerhead that causes rotation of a driveshaft, a steering housing located below the powerhead, wherein the driveshaft extends from the powerhead into the steering housing, and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

SUMMARY

This Summary is provided to introduce a selection of concepts which are further described herein below in the Detailed Description. This Summary is not intended to identify key or essential features of the claimed subject matter, nor is it intended to be used as an aid in limiting the scope of the claimed subject matter.

In non-limiting examples disclosed herein, a marine drive is for propelling a marine vessel. The marine drive includes a drive assembly configured to support a propulsor for generating a thrust force in water, the drive assembly including a driveshaft housing and a gearcase suspended from the driveshaft housing, wherein the drive assembly is trimmable relative to the marine vessel about a trim joint. A steering actuator is configured to steer the gearcase relative to the driveshaft housing, and a pump is configured to pump a hydraulic fluid to and/or from the steering actuator via the trim joint.

Optionally, the marine drive may comprise a mounting assembly configured to couple the driveshaft housing to the marine vessel. The hydraulic fluid may be conveyed through the mounting assembly and through the driveshaft housing. Optionally, the marine drive may include at least one mounting arm which pivotally couples the mounting assembly to the driveshaft housing, wherein the hydraulic fluid is conveyed through the at least one mounting arm. Optionally, the at least one mounting arm may be one of a port mounting arm and a starboard mounting arm, wherein the hydraulic fluid is conveyed through the port mounting arm and through the starboard mounting arm. Optionally, the port mounting arm and the starboard mounting arm may extend from a first one of the driveshaft housing and the mounting assembly and are coupled to a second one of the driveshaft housing and the mounting assembly along the trim joint.

Optionally, the trim joint may pivotably couple a stationary member and a rotary member, wherein the hydraulic fluid is conveyed through the stationary member and through the rotary member. Optionally, the stationary member is on the mounting assembly and the rotary member is on the driveshaft housing. Optionally, the marine drive may include a first fluid passage in the stationary member, a second fluid passage in the rotary member, and a chamber in the trim joint which fluidly couples the first fluid passage and the second fluid passage. Optionally, the marine drive may include a third fluid passage which is fluidly coupled to the second fluid passage in the rotary member, wherein the third passage extends from the rotary member to the steering actuator.

Optionally, the rotary member may include a stem which is rotatable within a cavity in the stationary member, the stem having at least one radial bore which is fluidly coupled to an annular passage which is fluidly coupled to the second fluid passage. Optionally, the marine drive may include at least one seal which seals an outer diameter surface of the stem to an inner diameter surface of the cavity. Optionally, the steering actuator may comprise a hydraulic cylinder. Optionally, the gearcase may include a steering housing which extends into the driveshaft housing, wherein the steering actuator may comprise a rack on the gearcase and a kingpin on the steering housing, and wherein movement of the rack rotates the kingpin and thereby steers the gearcase relative to the driveshaft housing. Optionally, the steering actuator may include a cylinder containing the rack, the rack being movable back and forth in the cylinder to steer the gearcase relative to the driveshaft housing.

In non-limiting examples, a marine drive is for propelling a marine vessel. The marine drive includes a drive assembly configured to support a propulsor for generating a thrust force in water, the drive assembly comprising a driveshaft housing and a gearcase suspended from the driveshaft housing. A mounting assembly is configured to couple the driveshaft housing to the marine vessel along a trim joint, wherein the drive assembly is trimmable relative to the mounting assembly about the trim joint. A steering actuator is configured to steer the gearcase relative to the driveshaft housing; and a pump is configured to pump a hydraulic fluid to and/or from the steering actuator via the trim joint.

Optionally, the hydraulic fluid may be conveyed through the mounting assembly and through the driveshaft housing. Optionally, the trim joint may pivotably couple a stationary member and a rotary member, wherein the hydraulic fluid is conveyed through the stationary member and through the rotary member.

In non-limiting examples, a marine drive is for propelling a marine vessel. The marine drive includes a drive assembly configured to support a propulsor for generating a thrust force in water, the drive assembly comprising a driveshaft housing and a gearcase suspended from the driveshaft housing. A mounting assembly is configured to couple the driveshaft housing to the marine vessel along a trim joint, wherein the drive assembly is trimmable relative to the mounting assembly about the trim joint. A steering actuator is configured to steer the gearcase relative to the driveshaft housing. A pump is configured to pump a hydraulic fluid to and/or from the steering actuator via passages which are entirely contained within the drive assembly and mounting assembly.

Optionally, the pump may be mounted on an opposite side of the mounting assembly relative to the drive assembly such that the pump is located in the marine vessel and the drive assembly is located outside of the marine vessel.

Optionally, the passages may include a first passage through the mounting assembly and a second passage through the drive assembly.

BRIEF DESCRIPTION OF THE DRAWINGS

The present disclosure includes the following figures.

DETAILED DESCRIPTION

Figure 1:
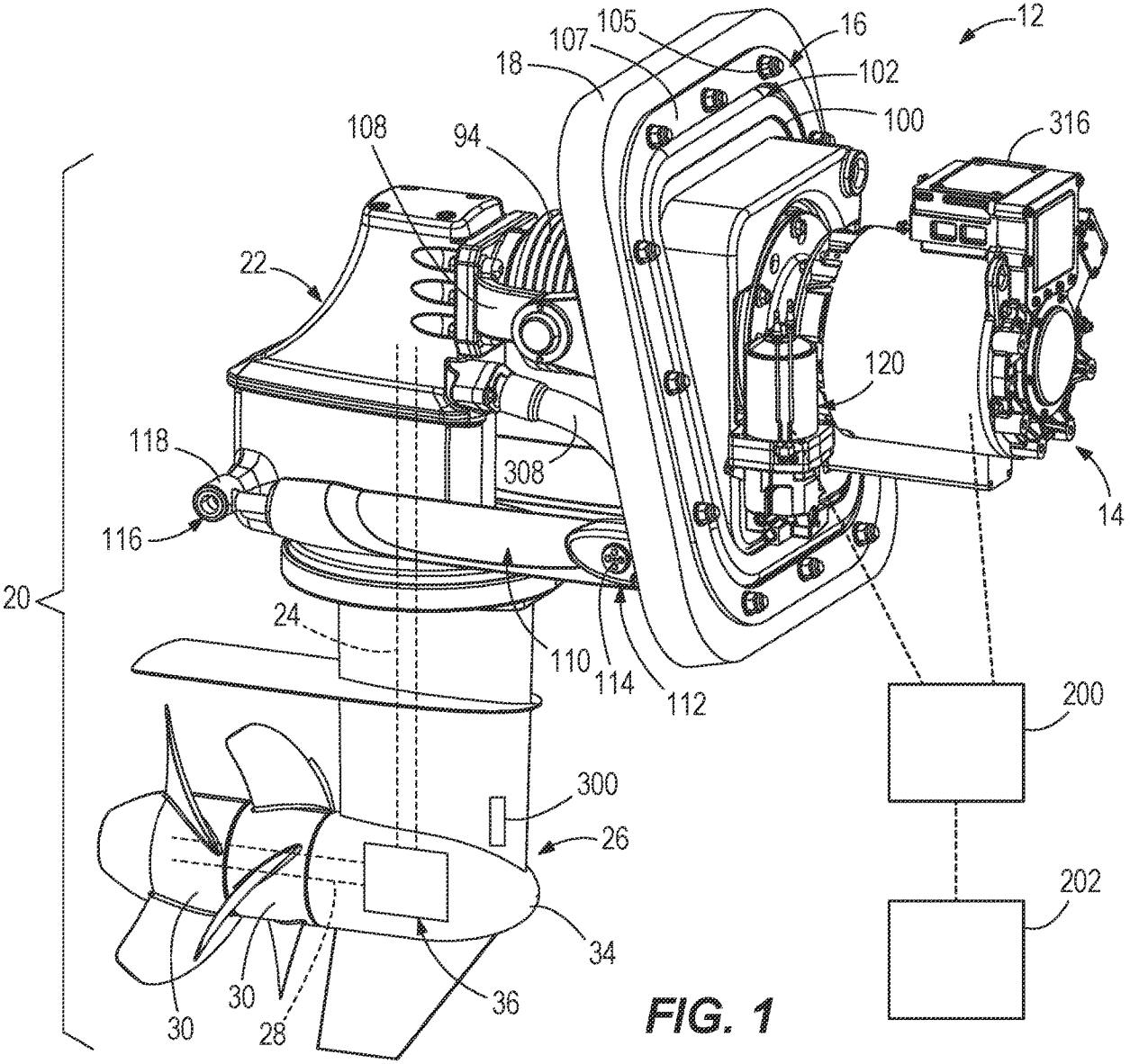
FIG. 1 is a starboard side perspective view of a stern drive according to the present disclosure.
Figure 2:
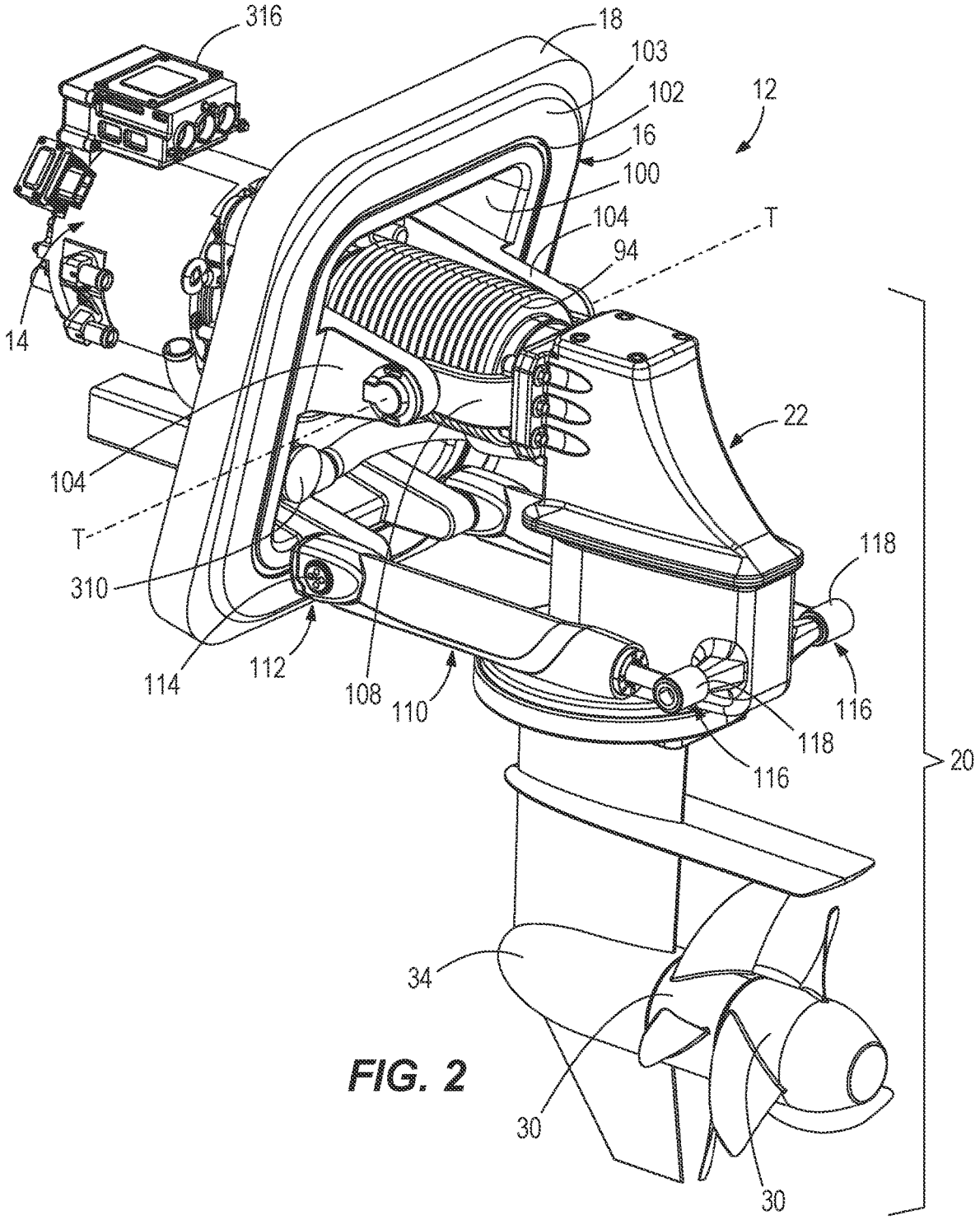
FIG. 2 is a port side perspective view of the stern drive.
Figure 3:
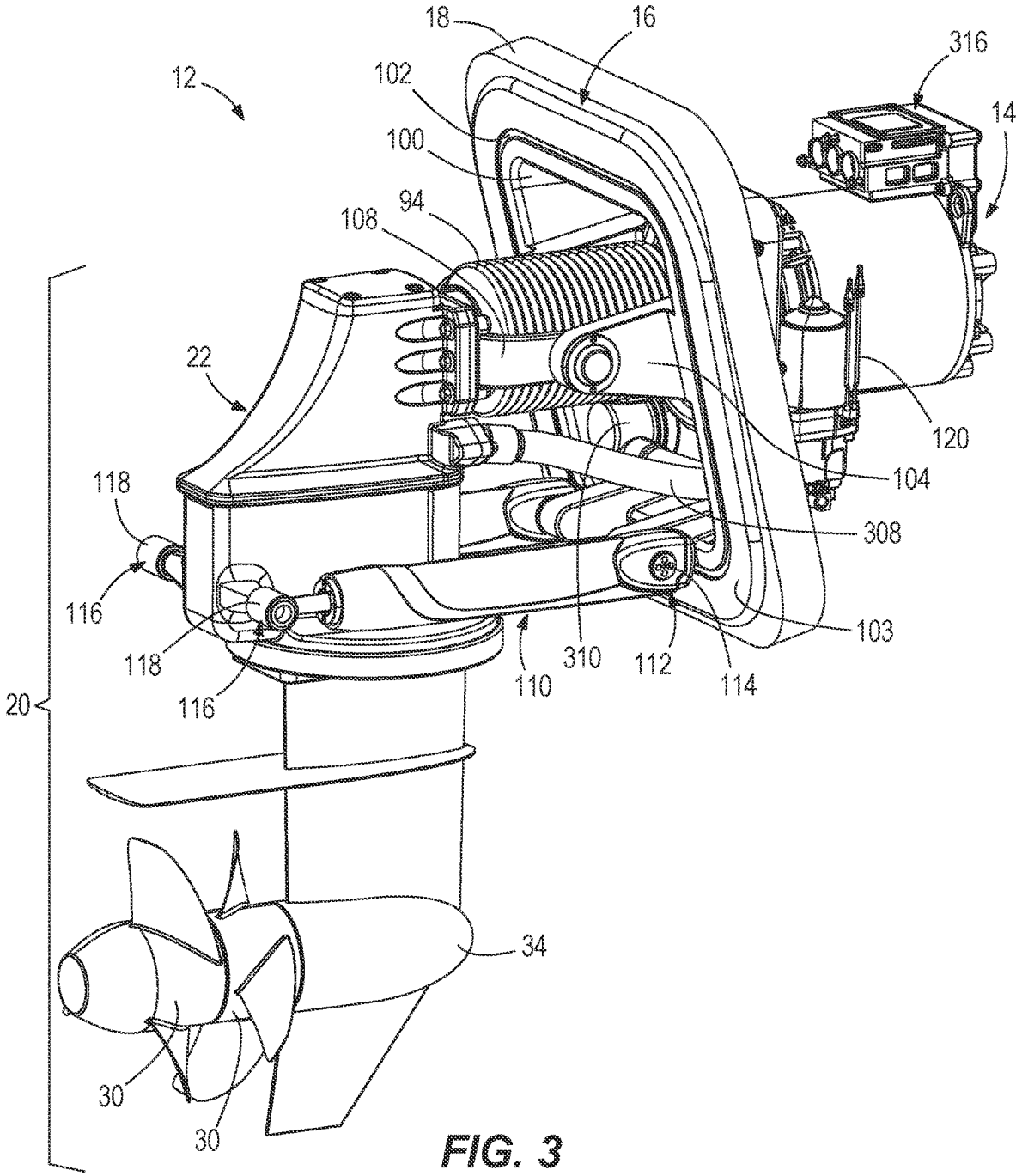
FIG. 3 is a starboard side perspective view of the stern drive.
Figure 4:
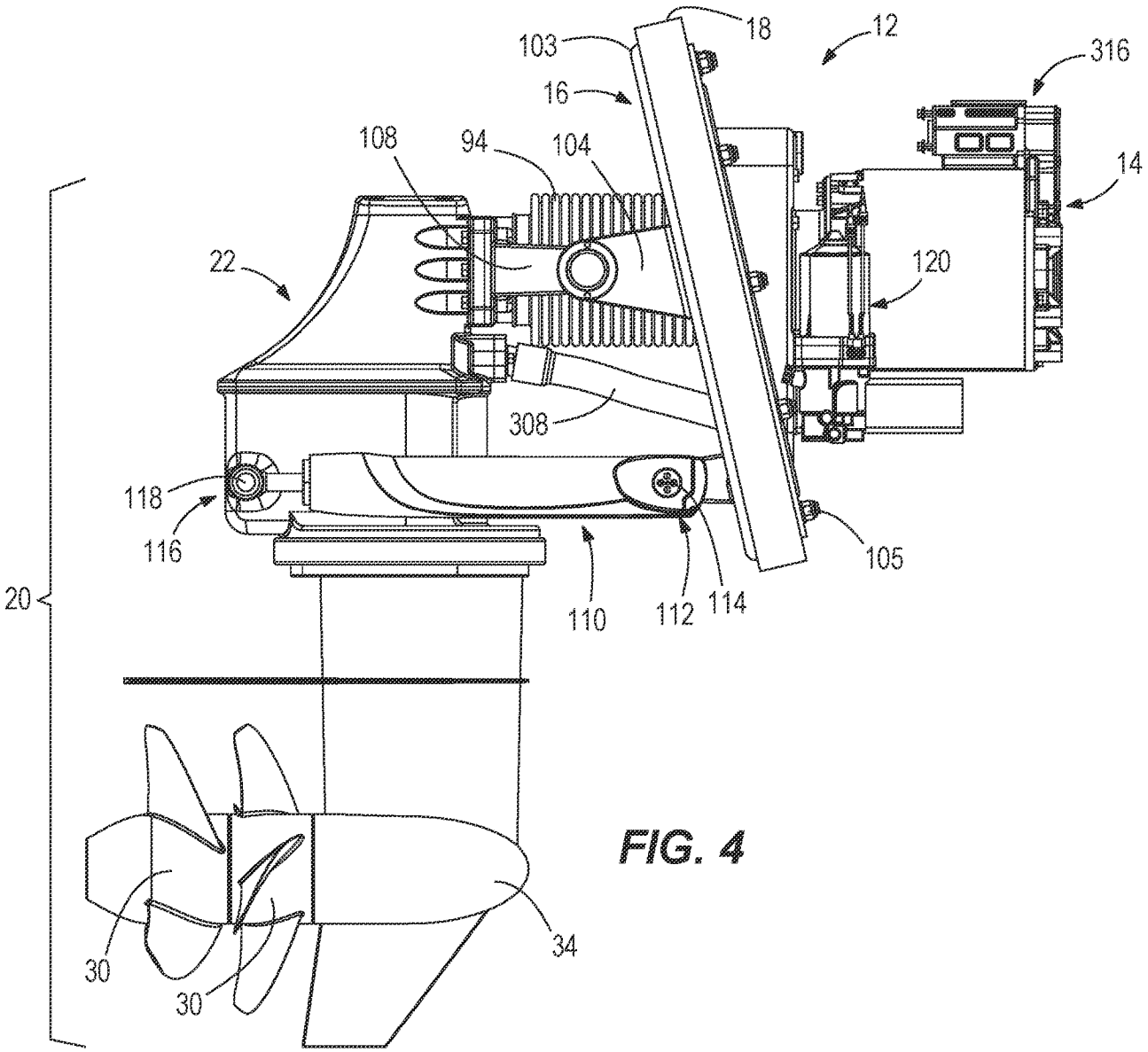
FIG. 4 is a starboard side view of the stern drive.

FIGS. 1-8 illustrate a stern drive 12 for propelling a marine vessel in a body of water. Referring to FIG. 1, the stern drive 12 has a powerhead, which in the illustrated example is an electric motor 14, a mounting assembly 16 which affixes the electric motor 14 to and suspends the electric motor 14 from the transom 18 of the marine vessel, and a drive assembly 20 coupled to the mounting assembly 16 and suspended therefrom. The illustrated powerhead is not limiting and in other examples the powerhead may include an engine and/or a combination of an engine and an electric motor, and/or any other suitable means for powering a marine drive. The mounting assembly 16 is configured so that the powerhead which in the illustrated example is an electric motor 14 is suspended (i.e., cantilevered) from the interior of the transom 18, above the hull of the marine vessel. As will be further explained below, the drive assembly 20 is trimmable up and down relative to the mounting assembly 16, including in non-limiting examples wherein a majority or an entirety of the drive assembly 20 is raised completely out of the water. The drive assembly 20 has a driveshaft housing 22 containing a driveshaft 24 and a gearcase 26 containing one or more output shaft(s) 28, e.g., one or more propulsor shaft(s). The output shaft(s) 28 extends from the rear of the gearcase 26 and support one or more propulsors(s) 30 configured to generate thrust in the water for propelling the marine vessel. The output shaft(s) 28 extend generally transversely to the driveshaft 24. In the illustrated example, propulsor(s) 30 include two counter-rotating propellers. However this is not limiting and the present disclosure is applicable to other arrangements, including arrangements wherein one or more output shaft(s) 28 are not counter-rotating and/or wherein the one or more output shaft(s) 28 extend from the front of the gearcase 26, and/or wherein the propulsor(s) 30 include one or more impellers and/or any other mechanism for generating a propulsive force in the water.

Figure 7:
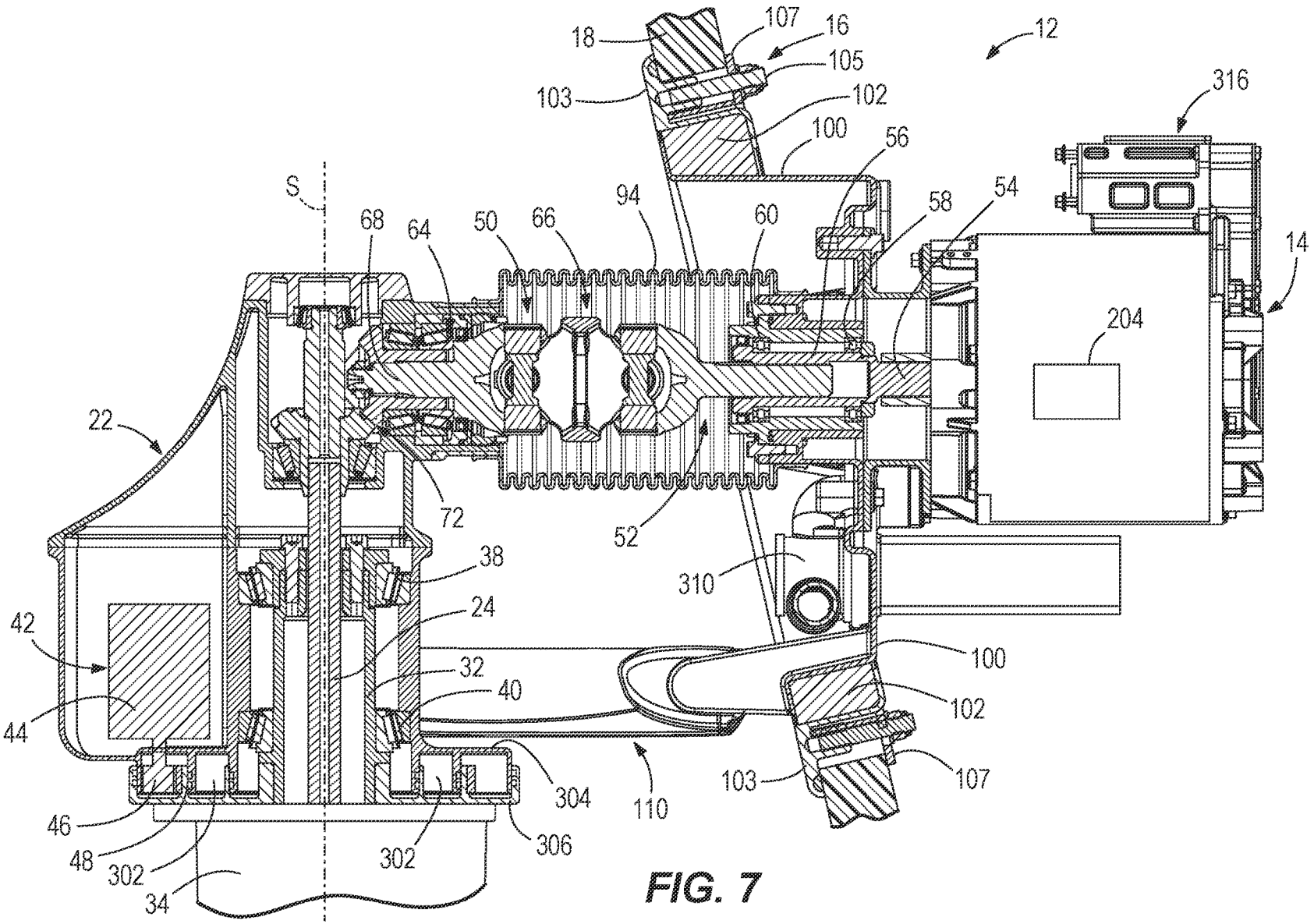
FIG. 7 is a starboard side sectional view of the stern drive.

Referring to FIGS. 1 and 7, the gearcase 26 is steerable about a steering axis S relative to the driveshaft housing 22. The gearcase 26 has a steering housing 32 which extends upwardly into the driveshaft housing 22, as well as a torpedo housing 34 which depends from the steering housing 32. An angle gearset 36 in the torpedo housing 34 operably couples the lower end of the driveshaft 24 to the output shaft(s) 28 so that rotation of the driveshaft 24 causes rotation of the output shaft(s) 28, which in turn causes rotation of the propulsor(s) 30.

Referring to FIG. 7, upper and lower bearings 38, 40 are disposed radially between the steering housing 32 and the driveshaft housing 22. The upper and lower bearings 38, 40 rotatably support the steering housing 32 relative to the driveshaft housing 22. A steering actuator 42 is configured to cause rotation of the gearcase 26 relative to the driveshaft housing 22. In the illustrated example, the steering actuator 42 is an electric motor 44 located in the driveshaft housing 22 and may be operatively engaged with the gearcase 26 via a gearset. The electric motor 44 has an output gear 46 (i.e., a pinion) which is meshed with a ring gear 48 on the steering housing 32 so that rotation of the output gear 46 causes rotation of the gearcase 26 about the steering axis S. As further explained below, operation of the electric motor 44 can be controlled via a conventional user input device located at the helm of the marine vessel or elsewhere, which facilitates control of the steering angle of the gearcase 26 and associated propulsors(s) 30. This facilitates steering control of the marine vessel. As discussed below in reference to FIGS. 14-22, the type and configuration of the steering actuator 42 can vary from what is shown and in other examples could include one or more hydraulic actuators, electro-hydraulic actuators, and/or any other suitable actuator for causing rotation of the gearcase 26. Other suitable examples are disclosed in the above-incorporated U.S. Pat. No. 10,800,502.

Figure 5:
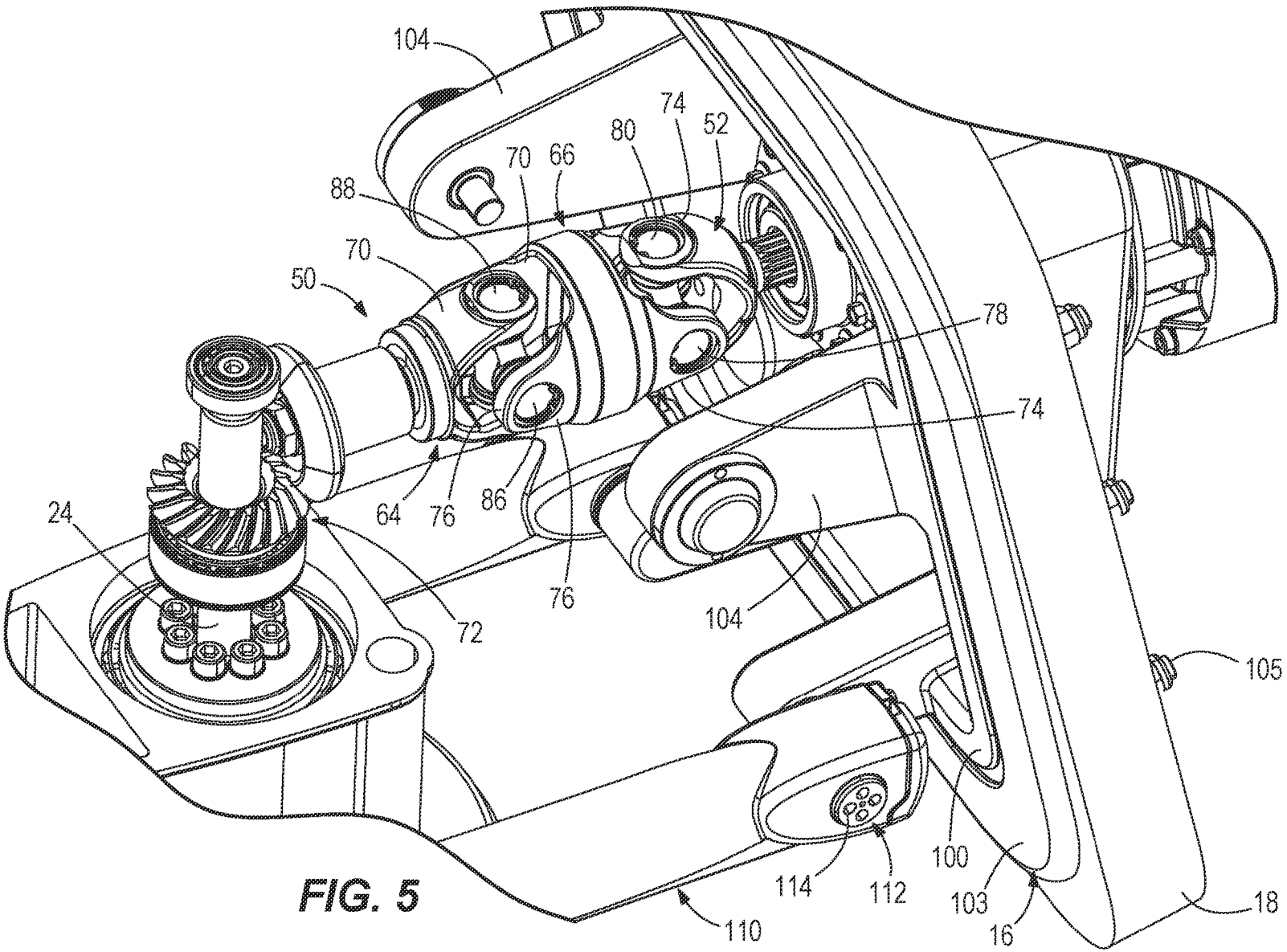
FIG. 5 is a perspective view looking down at a universal joint of the stern drive which couples a powerhead, which in the illustrated example includes an electric motor, to a driveshaft of the stern drive.
Figure 6:
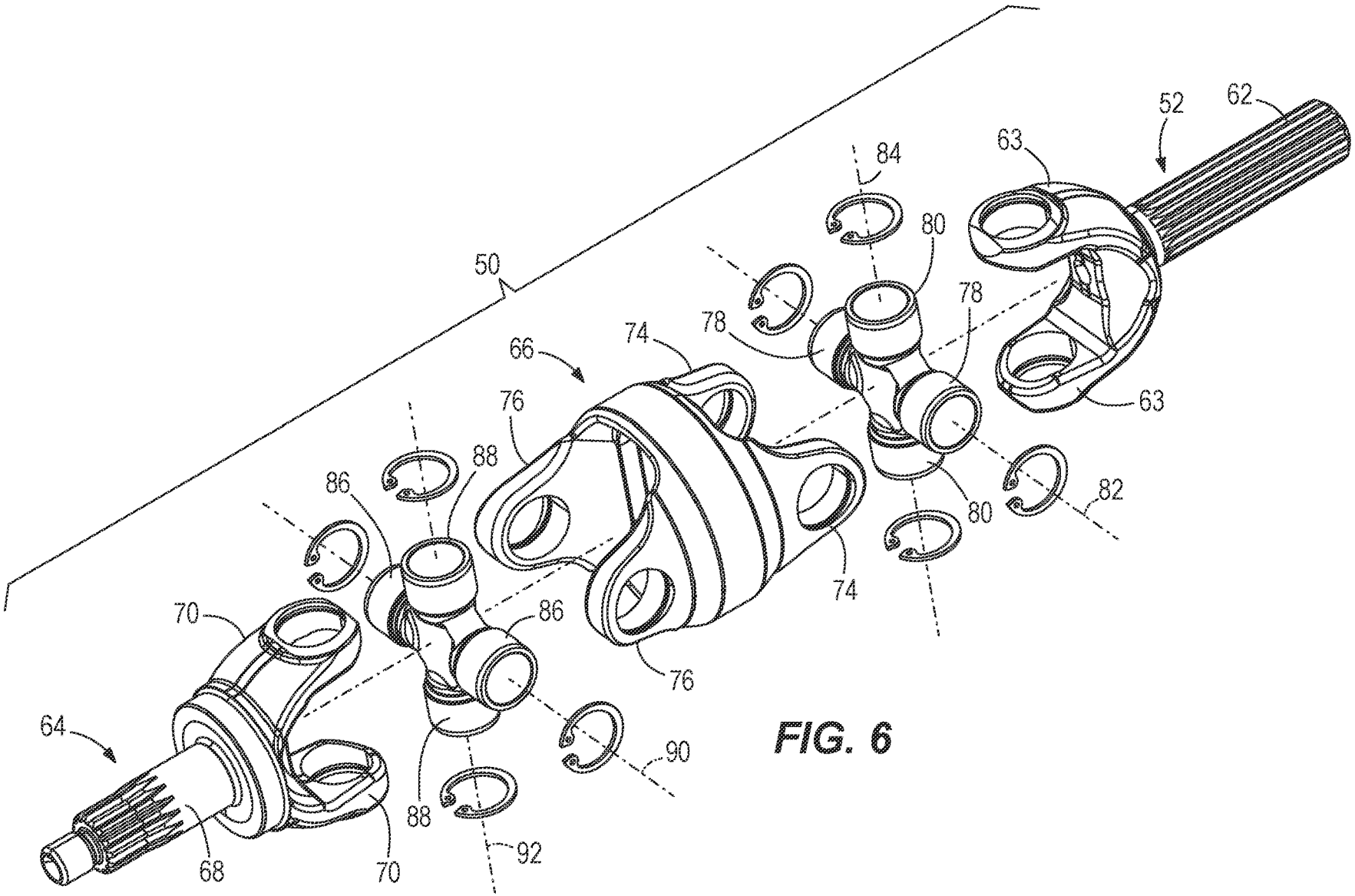
FIG. 6 is an exploded view of the universal joint.

Referring to FIGS. 5-7, a universal joint 50 couples the electric motor 14 to the driveshaft 24 so that operation of the electric motor 14 causes rotation of the driveshaft 24, which in turn causes rotation of the output shaft(s) 28. The universal joint 50 is also advantageously configured to facilitate trimming of the drive assembly 20 an amount sufficient to raise at least a majority of the drive assembly 20 out of the water, for example during periods of non-use. The universal joint 50 has an input member 52 which is rotatably engaged with an output shaft 54 of the electric motor 14, an output member 64 which is rotatably engaged with the driveshaft 24, and an elongated body 66 which rotatably couples the input member 52 to the output member 64. The input member 52 has an externally-splined input shaft 62 and input arms 63 which form a U-shape. The output member 64 has an output shaft 68 and output arms 70 which form a U-shape. The elongated body 66 has a first pair of arms 74 which form a U-shape and an opposing second pair of arms 76 which form a U-shape. Input pivot pins 78, 80 pivotably couple the input arms 63 of the input member 52 to the first pair of arms 74 of the elongate body 66 along a first input pivot axis 82 and along a second input pivot axis 84 which is perpendicular to the first input pivot axis 82. Output pivot pins 86, 88 pivotably couple the output arms 70 of the output member 64 to the second pair of arms 76 of the elongated body 66 along a first output pivot axis 90 and along a second output pivot axis 92 which is perpendicular to the first output pivot axis 90.

Referring to FIG. 7, an internally splined sleeve 56 is rotatably supported in the mounting assembly 16 by inner and outer bearings 58, 60. The output shaft 54 of the electric motor 14 is fixed to the splined sleeve 56 so that rotation of the output shaft 54 causes rotation of the splined sleeve 56. The externally-splined input shaft 62 of the universal joint 50 extends into meshed engagement with the splined sleeve 56 so that rotation of the splined sleeve 56 causes rotation of the input member 52. The output shaft 68 of the universal joint 50 is coupled to the driveshaft 24 by an angle gearset 72 located in the driveshaft housing 22 and configured so that rotation of the output member 64 causes rotation of the driveshaft 24. Thus, it will be understood that operation of the electric motor 14 causes rotation of the universal joint 50, which in turn causes rotation of the driveshaft 24 and output shaft(s) 28. The splined engagement between the input member 52 and splined sleeve 56 also advantageously permits telescoping movement of the input member 52 during trimming of the drive assembly 20, as will be further described below with reference to FIGS. 8-9. A flexible bellows 94 encloses the universal joint 50 relative to the mounting assembly 16 and the driveshaft housing 22.

Referring now to FIGS. 1-4 and 7, the mounting assembly 16 has a rigid mounting plate 100, a vibration dampening (e.g., rubber or other pliable and/or resilient material) mounting ring 102, and a rigid mounting ring 103 which is fastened to the transom 18 by fasteners 105 and a fastening ring 107 to couple the vibration dampening mounting ring 102 and rigid mounting plate 100 to the transom 18. A pair of rigid mounting arms 104 extends rearwardly from the rigid mounting plate 100 and is pivotably coupled to a rigid, U-shaped mounting bracket 108 extending forwardly from the top of the driveshaft housing 22. The pivot joint between the rigid mounting arms 104 and mounting bracket 108 defines a trim axis T (see FIG. 2) about which the drive assembly 20 is pivotably (trimmable), up and down relative to the mounting assembly 16. The type and configuration of mounting assembly 16 can vary from what is shown, and a non-limiting example of the mounting assembly 16 is described herein below with reference to FIGS. 14-21.

Trim cylinders 110 are located on opposite sides of the mounting assembly 16. The trim cylinders 110 have a first end 112 pivotably coupled to the rigid mounting plate 100 at a first pivot joint 114 and an opposite, second end 116 pivotably coupled to the drive assembly 20 at a second pivot joint 118. A hydraulic actuator 120 (see FIG. 11) which in this example includes a pump and associated valves and line components, is mounted to the interior of the rigid mounting plate 100. The hydraulic actuator 120 is hydraulically coupled to the trim cylinders 110 via a least one internal passage through the mounting assembly 16 and the first pivot joint 114, advantageously so that there are no other hydraulic lines located on the exterior of the stern drive 12, or otherwise outside the marine vessel so as to be subjected to wear and/or damage from external elements. The hydraulic actuator 120 is operable to supply hydraulic fluid to the trim cylinders 110 via the noted internal passage to cause extension of the trim cylinders 110 and alternately to cause retraction of the trim cylinders 110. Extension of the trim cylinders 110 pivots (trims) the drive assembly 20 upwardly relative to the mounting assembly 16 and retraction of the trim cylinders 110 pivots (trims) the drive assembly 20 downwardly relative to the mounting assembly 16. Examples of a suitable hydraulic actuator are disclosed in the above-incorporated U.S. Pat. No. 9,334,034.

Figure 8:
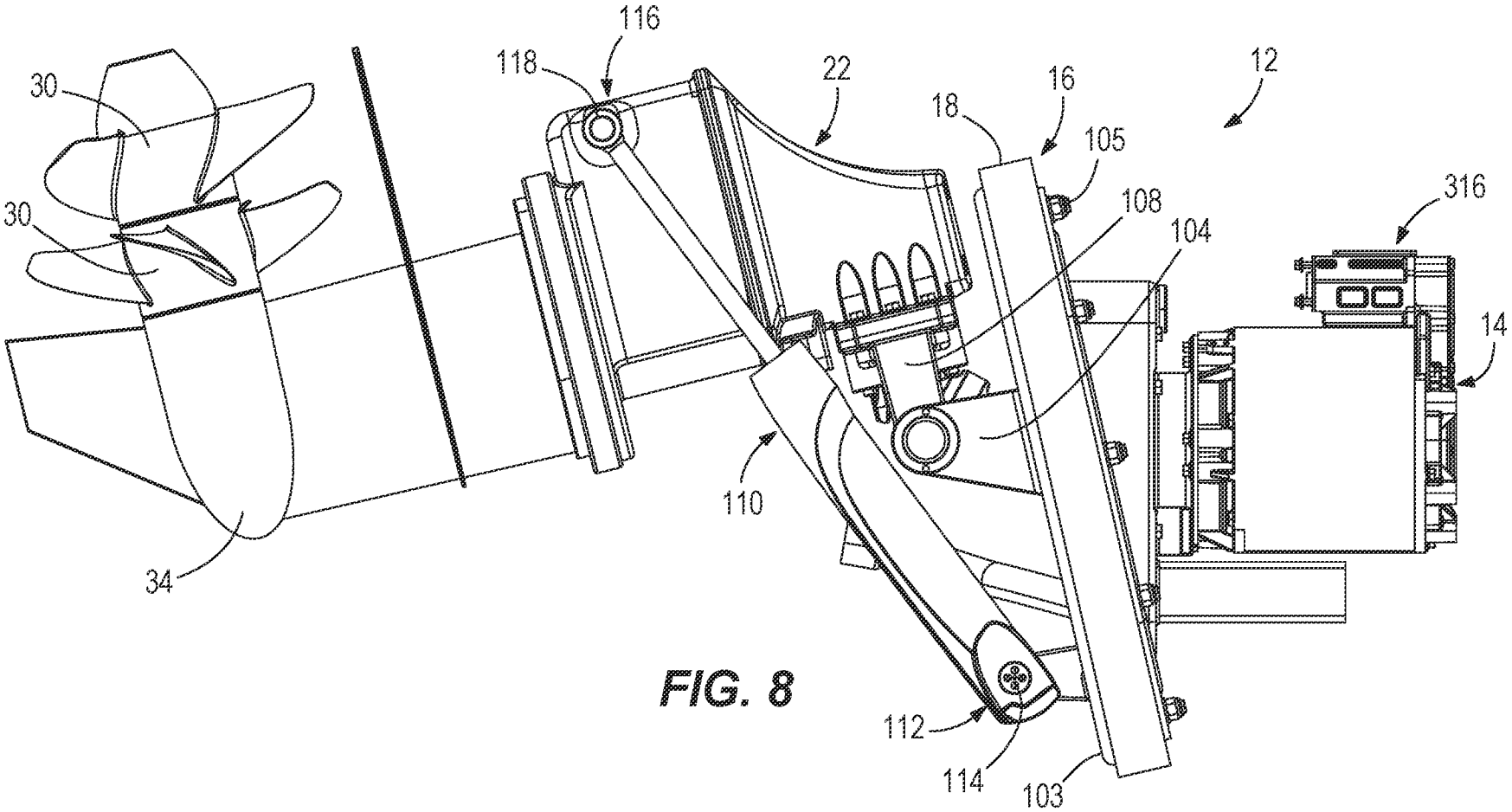
FIG. 8 is a starboard side view of the stern drive in a trimmed-up position.
Figure 9:
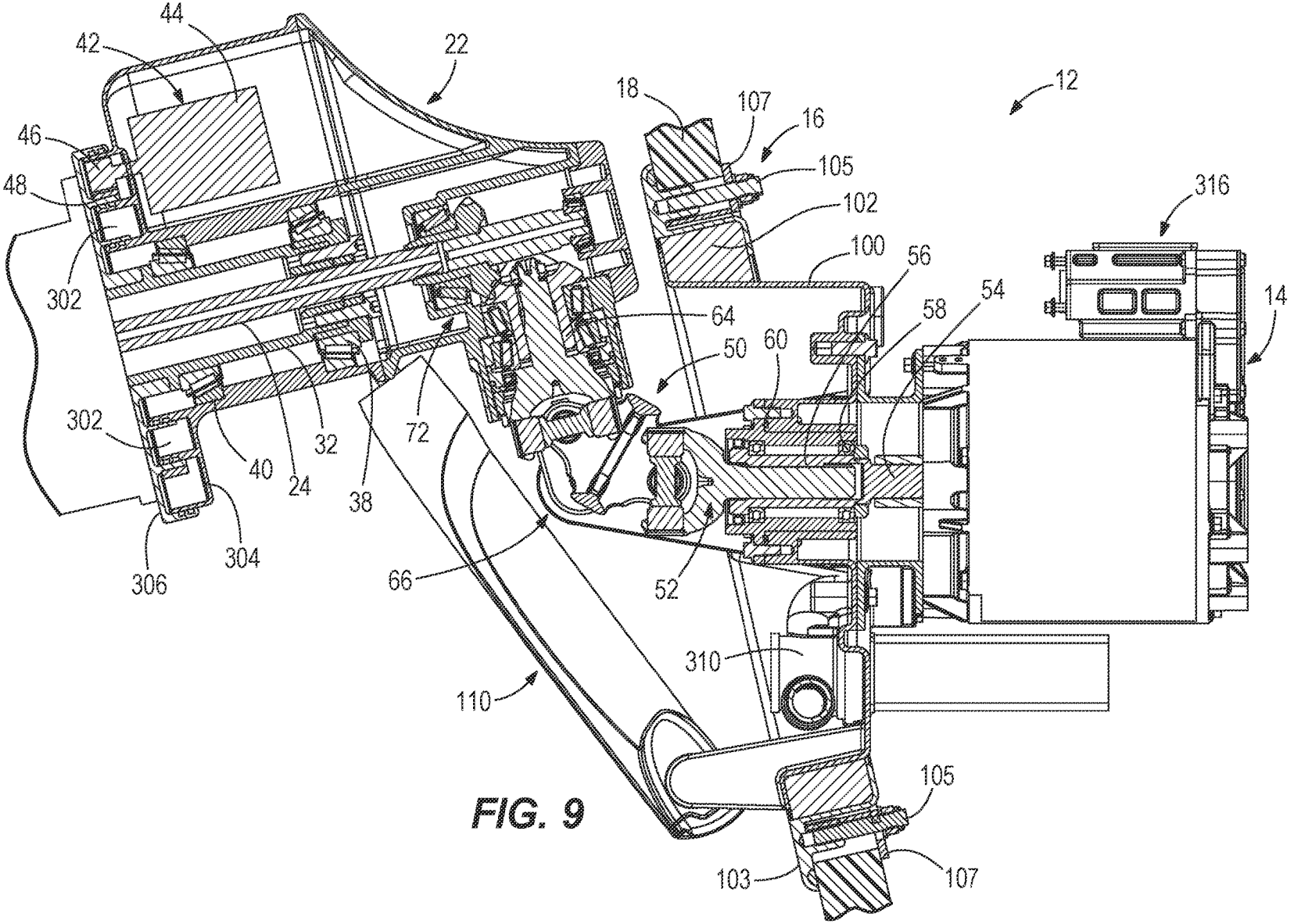
FIG. 9 is a starboard side sectional view of the stern drive in the trimmed-up position.

By comparison of FIGS. 7-9, it will be seen that the universal joint 50 advantageously facilitates trimming of the drive assembly 20 about the trim axis T while maintaining operable connection between the electric motor 14 and the output shaft(s) 28. In particular, as the drive assembly 20 is trimmed, the elongated body 66 is configured to also pivot about the first and/or second input pivot axes 82, 84 (via input pivot pins 78, 80), and the output member 64 is configured to also pivot about the first and/or second output pivot axes 90, 92 (via output pivot pins 86, 88). As explained above, the input shaft 62 is coupled to the internally splined sleeve 56 by a splined coupling so that the input shaft 62 is free to telescopically move outwardly relative to the internally splined sleeve 56 and mounting assembly 16 when the drive assembly 20 is trimmed up and so that the input shaft 62 is free to telescopically move inwardly relative to the mounting assembly 16 when the drive assembly 20 is trimmed down.

A controller 200 is communicatively coupled to the electric motor 14, the steering actuator 42, and the hydraulic actuator 120. The controller 200 is configured to control operation of the electric motor 14, the steering actuator 42, and the hydraulic actuator 120. More specifically, the controller 200 is configured to control the electric motor 14 to rotate the universal joint 50, the driveshaft 24 and the output shaft(s) 28, thereby controlling the thrust force generated by the propulsor(s) 30 in the water. The controller 200 is configured to control the steering actuator 42 to rotate the gearcase 26 about the steering axis S. The controller 200 is configured to control the hydraulic actuator 120 to extend and alternately to retract the trim cylinders 110 to trim the drive assembly 20 about the trim axis T.

The type and configuration of the controller 200 can vary. In non-limiting examples, the controller 200 has a processor which is communicatively connected to a storage system comprising a computer readable medium which includes volatile or nonvolatile memory upon which computer readable code and data is stored. The processor can access the computer readable code and, upon executing the code, carry out functions, such as the controlling functions for the electric motor 14, steering actuator 42, and the hydraulic actuator 120. In other examples the controller 200 is part of a larger control network such as a controller area network (CAN) or CAN Kingdom network, such as disclosed in U.S. Pat. No. 6,273,771. A person having ordinary skill in the art will understand that various other known and conventional computer control configurations could be implemented and are contemplated by the present disclosure, and that the control functions described herein may be combined into a single controller or divided into any number of distributed controllers which are communicatively connected.

The controller 200 is in electrical communication with the electric motor 14, the steering actuator 42, and the hydraulic actuator 120 via one or more wired and/or wireless links. In non-limiting examples, the wired and/or wireless links are part of a network, as described above. The controller 200 is configured to control the electric motor 14, the steering actuator 42, and the hydraulic actuator 120 by sending and optionally by receiving said signals via the wired and/or wireless links. The controller 200 is configured to send electrical signals to the electric motor 14 which cause the electric motor 14 to operate in a first direction to rotate the universal joint 50, the driveshaft 24 and the output shaft(s) 28 in a first direction, thereby generating a first (e.g., forward) thrust force in the water via the propulsor(s) 30, and alternately to send electric signals to the electric motor 14 which cause the electric motor 14 to operate in an opposite, second direction, to rotate the universal joint 50, the driveshaft 24 and the output shaft(s) 28 in an opposite direction which generates a second (e.g., reverse) thrust force in the water via the propulsor(s) 30. The controller 200 is configured to send electric signals to the steering actuator 42 which cause the steering actuator 42 to rotate the gearcase 26 in a first direction about the steering axis S and alternately to send electric signals to the steering actuator 42 which cause the steering actuator 42 to rotate the gearcase 26 in an opposite direction about the steering axis S. The controller 200 is configured to send electrical signals to the hydraulic actuator 120 which cause the hydraulic actuator 120 to provide hydraulic fluid to one side of the trim cylinders 110 to extend the trim cylinders 110 and trim the drive assembly 20 upwardly relative to the mounting assembly 16 and alternately to send electric signals to the hydraulic actuator 120 which cause the hydraulic actuator 120 to provide hydraulic fluid to an opposite side of the trim cylinders 110 to retract the trim cylinders 110 and trim the drive assembly 20 downwardly relative to the mounting assembly 16.

A user input device 202 is provided for inputting a user-desired operation of the electric motor 14, and/or a user desired operation of the steering actuator 42, and/or a user-desired operation of the hydraulic actuator 120. Upon input of the user-desired operation, the controller 200 is programmed to control the electric motor 14, and/or the steering actuator 42, and/or the hydraulic actuator 120 accordingly. The user input device 202 can include any conventional device which can be communicatively connected to the controller 200 for inputting a user-desired operation, including but not limited to one or more switches, levers, joysticks, buttons, touch screens, and/or the like.

Referring to FIG. 7, one or more sensor(s) 204 are provided for directly or indirectly sensing a rotational orientational position of the universal joint 50 and communicating this information to the controller 200. In non-limiting examples, the sensor 204 comprises one or more conventional magnetic pick-up coil(s), Hall-effect sensor(s), magneto-resistive element (MRE) sensor(s), and/or optical sensor(s), such as are available for purchase from Parker Hannifin Corp., among other places. The sensor(s) 204 may be configured to sense the orientational position of the universal joint 50 by sensing the rotational position of the output shaft of the electric motor 14 and/or the rotational position of the internally splined sleeve 56 and/or by sensing the rotational position of the input gear of the angle gearset 72, for example. In other examples, the sensor(s) 204 may also or alternately be configured to directly sense the orientational position of one or more rotatable component of the universal joint 50. The location of the one or more sensor(s) can vary, but preferably is located to be able to accurately sense a rotating part of the assembly for which an orientation between the splines and gears is known.

The controller 200 is configured to automatically cause the electric motor 14 to rotate the universal joint 50 into the neutral position shown in the figures (e.g., see FIGS. 5 and 7), wherein the first input pivot axis 82 and the first output pivot axis 90 are aligned with each other and generally parallel to the trim axis T. This advantageously facilitates trimming of the drive assembly 20 fully out of the water. More specifically, rotating the universal joint 50 into the neutral position with the first input pivot axis 82 and the first output pivot axis 90 oriented generally parallel to the trim axis T locates the first pair of arms 74 at a ninety degree offset from the input arms 63 of the input member 52 and thus permits the first pair of arms 74 of the elongated body 66 to pivot through a maximum allowable range about the first input pivot axis 82 within the U-shape formed by the input arms 63, as shown in FIG. 9. Similarly, rotating the universal joint 50 into the neutral position locates the output arms 70 of the output member 64 at a ninety-degree offset from the second pair of arms 76 of the elongated body 66 and thus permits the output arms 70 to pivot through a maximum allowable range about the first output pivot axis 90 within the U-shape formed by the second pair of arms 76, as shown in FIG. 9.

The controller 200 is advantageously programmed to automatically operate the electric motor 14 to rotate the universal joint 50 into the neutral position as indicated by the sensor 204 based upon an operational state of the stern drive 12. The operational state can for example include change in an on/off state of the electric motor 14 (for example a key on or key off event) and/or any other designated programmed request or request input to the controller 200 via the user input device 202.

Figure 11:
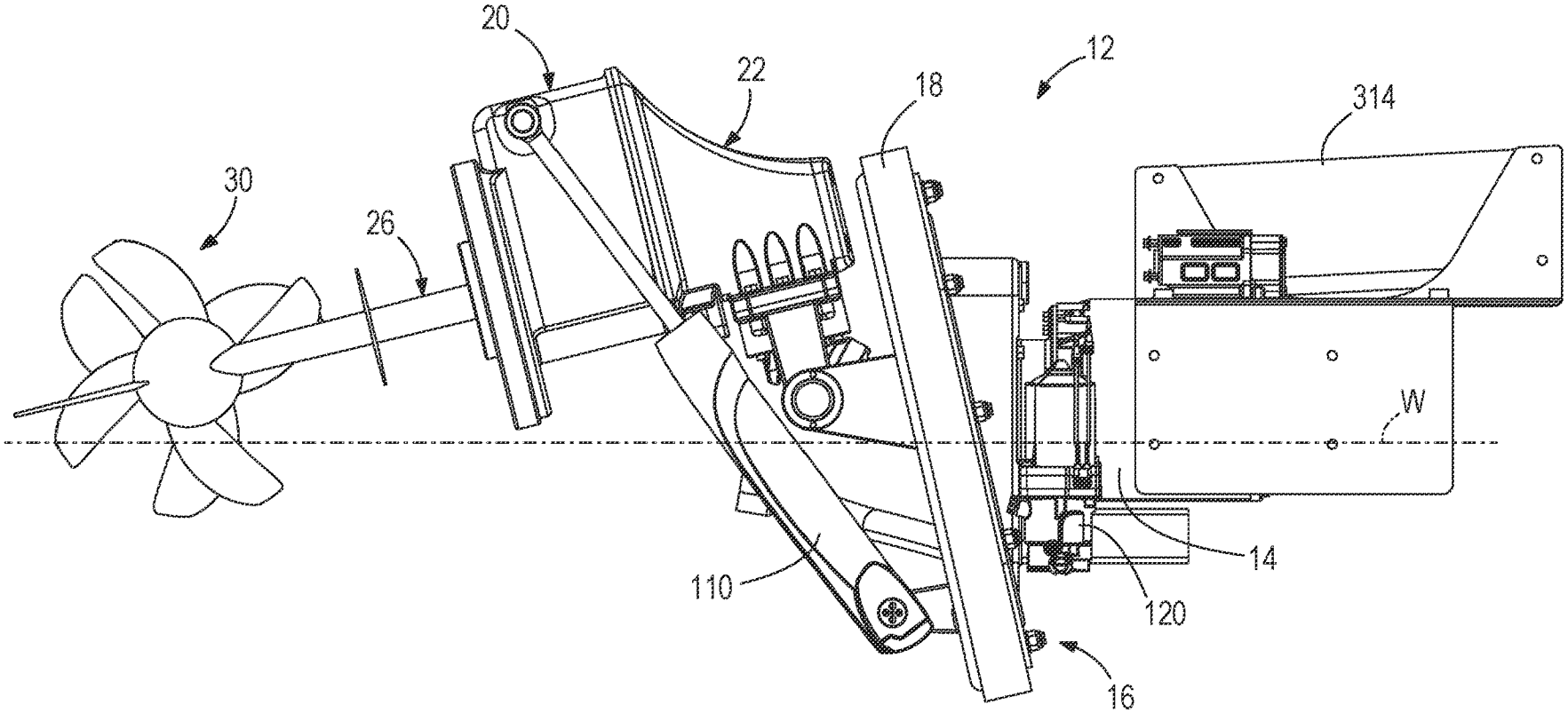
FIG. 11 is a starboard side perspective view of the stern drive in the trimmed-up position and steered ninety degrees off center (straight-ahead) so that the drive assembly of the stern drive is trimmed fully out of the water.

In a non-limiting example, a user can actuate the user input device 202 to command the controller 200 to control the hydraulic actuator 120 to trim the drive assembly 20 into a fully raised, storage position. Upon receiving said command, the controller 200 is programmed to automatically control the electric motor 14 to rotate the universal joint 50 into the noted neutral position. As explained above, this advantageously facilitates trimming all or at least a majority of the drive assembly 20 out of the water. For example the majority may include all of the driveshaft housing 22 and a majority of the gearcase 26. Referring to FIG. 11, the controller 200 can be also configured to automatically operate the steering actuator 42 to steer (i.e., rotate) the drive assembly 20 about the steering axis S, for example into the position shown, which is ninety degrees offset to either one of the port or starboard sides. This can occur prior to, during, or after the drive assembly 20 is trimmed upwardly via the universal joint 50. Steering the drive assembly 20 into the position shown (or into the 180 degree opposite position of what is shown) advantageously further elevates the lowermost point of the drive assembly 20 (which typically is on the torpedo housing 34 or skeg of the gearcase 26) further above the waterline W, thus ensuring that the entirety of the drive assembly 20, including all of the driveshaft housing 22 and all of the gearcase 26, is positioned out of the body of water. Thus the present disclosure contemplates methods for operating the stern drive 12, including the steps of operating the electric motor 14 to rotate the universal joint 50 into the aforementioned neutral position, which facilitates trimming of the drive assembly 20 upwardly relative to the rest of the stern drive 12, and optionally also steering the gearcase 26 relative to the driveshaft housing 22, before, during or after the trimming of the drive assembly 20, thereby moving an entirety of the drive assembly 20 further upwardly relative to the stern drive 12 and ensuring that the entirety of the drive assembly 20 is positioned out of the body of water. This advantageously locates the majority or entirety of the drive assembly 20 out of the body of water during periods of non-use, thus preventing deleterious effects of the water on the drive assembly 20.

Figure 10:
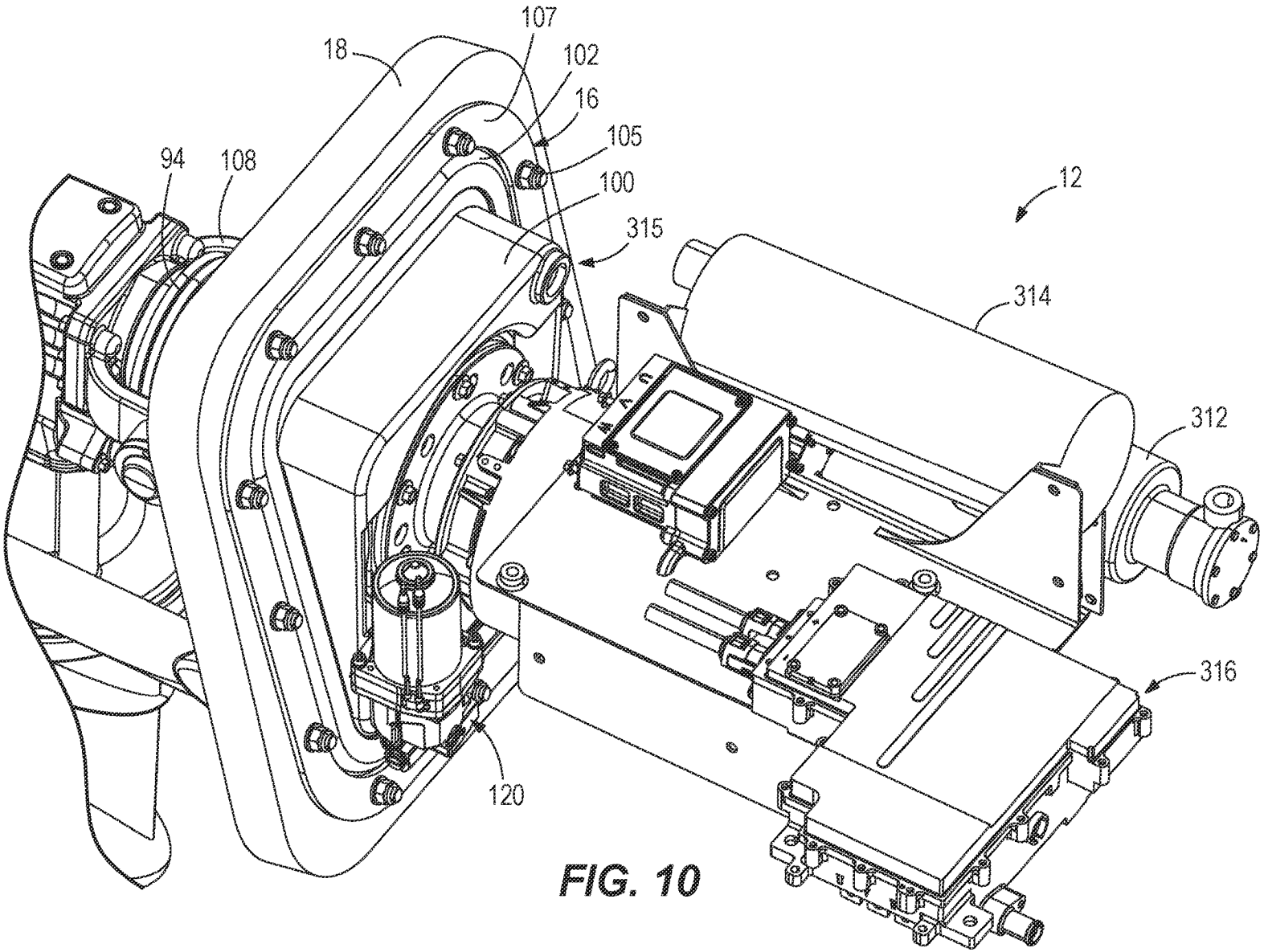
FIG. 10 is a starboard side perspective view of a mounting assembly which mounts the electric motor to the transom of a marine vessel.

Referring to FIG. 7, the stern drive 12 has a cooling system for cooling various components thereof, including for example the electric motor 14. In the non-limiting example shown in the drawings, the cooling system includes an open loop cooling circuit for circulating cooling water from the body of water in which the stern drive 12 is situated and then discharging the cooling water back to the body of water. The open loop cooling circuit includes an intake inlet 300 (see FIG. 1) on the gearcase 26 which is connected to an annular cooling channel 302 defined between a lower annular flange 304 on the lower end of the driveshaft housing 22 and an annular flange 306 on the top of the gearcase 26. Reference is made to the above-incorporated U.S. Pat. No. 10,800,502. A flexible conduit 308 is coupled to the driveshaft housing 22 and configured to convey the cooling water from the annular cooling channel 302 to a cooling water pump 310 mounted on the outside of the rigid mounting plate 100. The cooling water pump 310 is configured to draw the cooling water in through the intake inlet 300, see FIG. 1, through the annular cooling channel 302, and through the flexible conduit 308. The cooling water pump 310 pumps the cooling water through the mounting assembly 16 to a heat exchanger 314 and then to an outlet 315 shown in FIG. 10. In the illustrated example, the stern drive 12 further includes a closed loop cooling circuit having a pump 312 for pumping cooling fluid such as a mixture of water and ethylene glycol through the heat exchanger 314, exchanging heat with the cooling water in the open loop cooling circuit. The mixture of water and ethylene glycol is circulated past the electric motor 14, an associated inverter 316, and one or more batteries for powering the electric motor 14, thus cooling these components.

Figure 12:
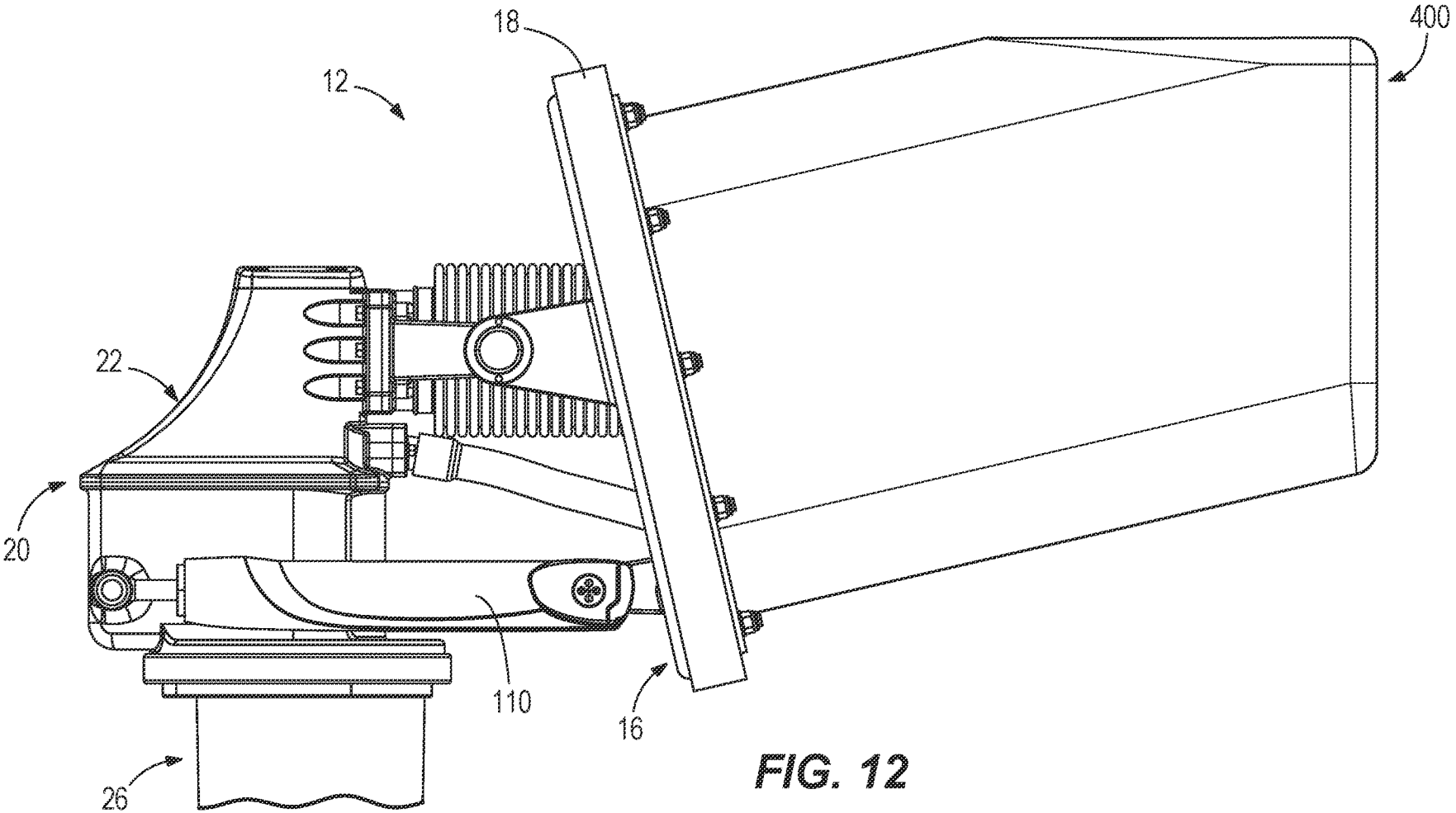
FIG. 12 is a starboard side view of an example sound enclosure for the stern drive.
Figure 13:
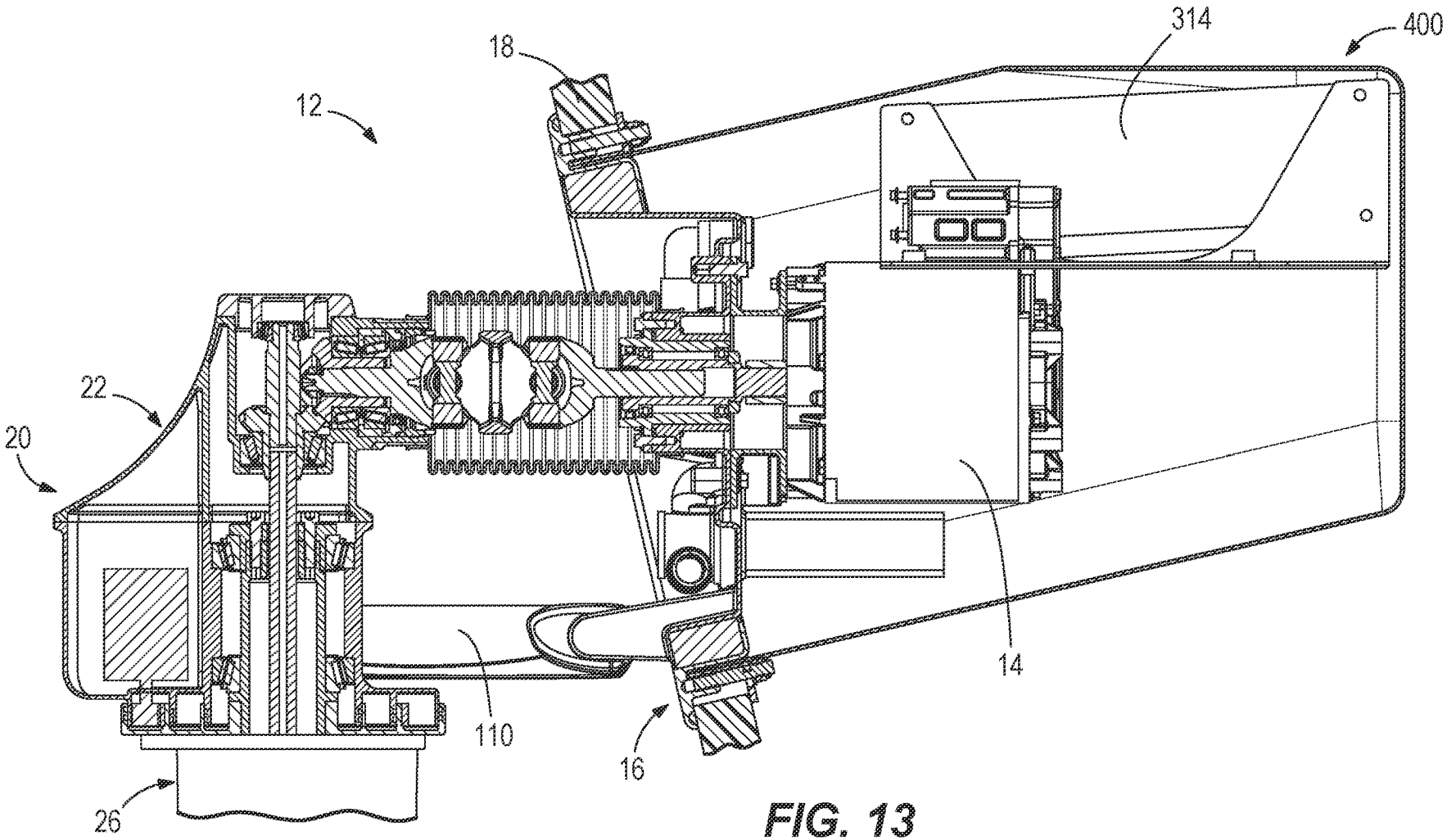
FIG. 13 is a starboard side sectional view of the example shown in FIG. 12.

Referring to FIGS. 12 and 13, in non-limiting examples, the stern drive 12 also has a sound absorbing enclosure 400 which encloses the inboard portions of the stern drive 12 and advantageously limits noise emanating from the stern drive 12. The sound absorbing enclosure 400 can be made of foam and/or any other conventional sound absorbing material, such as a sheet molding compound (SMC). In the illustrated example, the sound absorbing enclosure 400 completely encloses the inboard components of the stern drive 12 and is fixed to the mounting assembly 16. In other examples, the sound absorbing enclosure 400 is configured to only enclose some of the inboard components of the stern drive 12.

As previously discussed, some embodiments of a stern drive 12 may be configured with a steering arrangement that is different than the steering arrangement of the stern drive 12 of FIGS. 1-13. For example, referring to FIGS. 14-16, embodiments of a stern drive 12 may be configured with a hydraulically actuated steering actuator 410. Similar to the embodiments of FIGS. 1-13, the stern drive 12 of FIGS. 14-16 includes the powerhead 14 configured to power the propulsor 30 (see FIG. 1) and the rest of a drive assembly 20 supported on the transom 18 of the marine vessel by a mounting assembly 16. The drive assembly 20 is configured to support a propulsor 30 for generating a thrust force in water and includes the powerhead 14, a driveshaft housing 22, and a gearcase 26 suspended from the driveshaft housing 22. The driveshaft housing 22 includes an upper housing portion 404 which houses the angle gearset 72 which couples the universal joint 50 to the driveshaft 24 and a lower housing portion 406 which is coupled to the second ends 116 of the trim cylinders 110 at the second pivot joints 118 on the port and starboard sides of the lower driveshaft housing portion 406. The gearcase 26 is steerable about a steering axis S (see FIG. 15) relative to the driveshaft housing 22, and the steering actuator 410 on the driveshaft housing 22 is configured to steer the gearcase 26 relative to the driveshaft housing 22.

Figure 15:
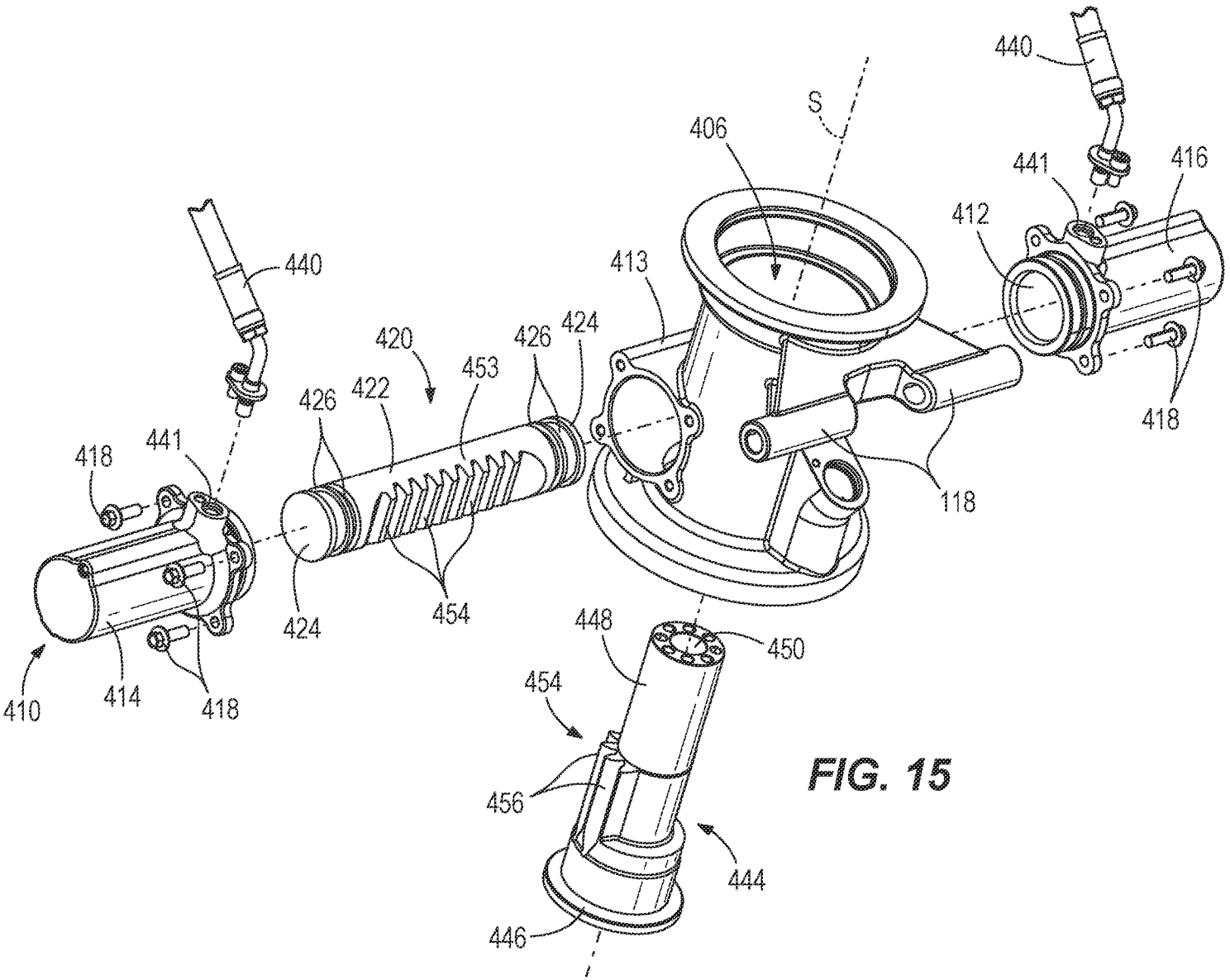
FIG. 15 is an exploded perspective view of the gearcase and steering actuator of the stern drive of FIG. 14.
Figure 16:
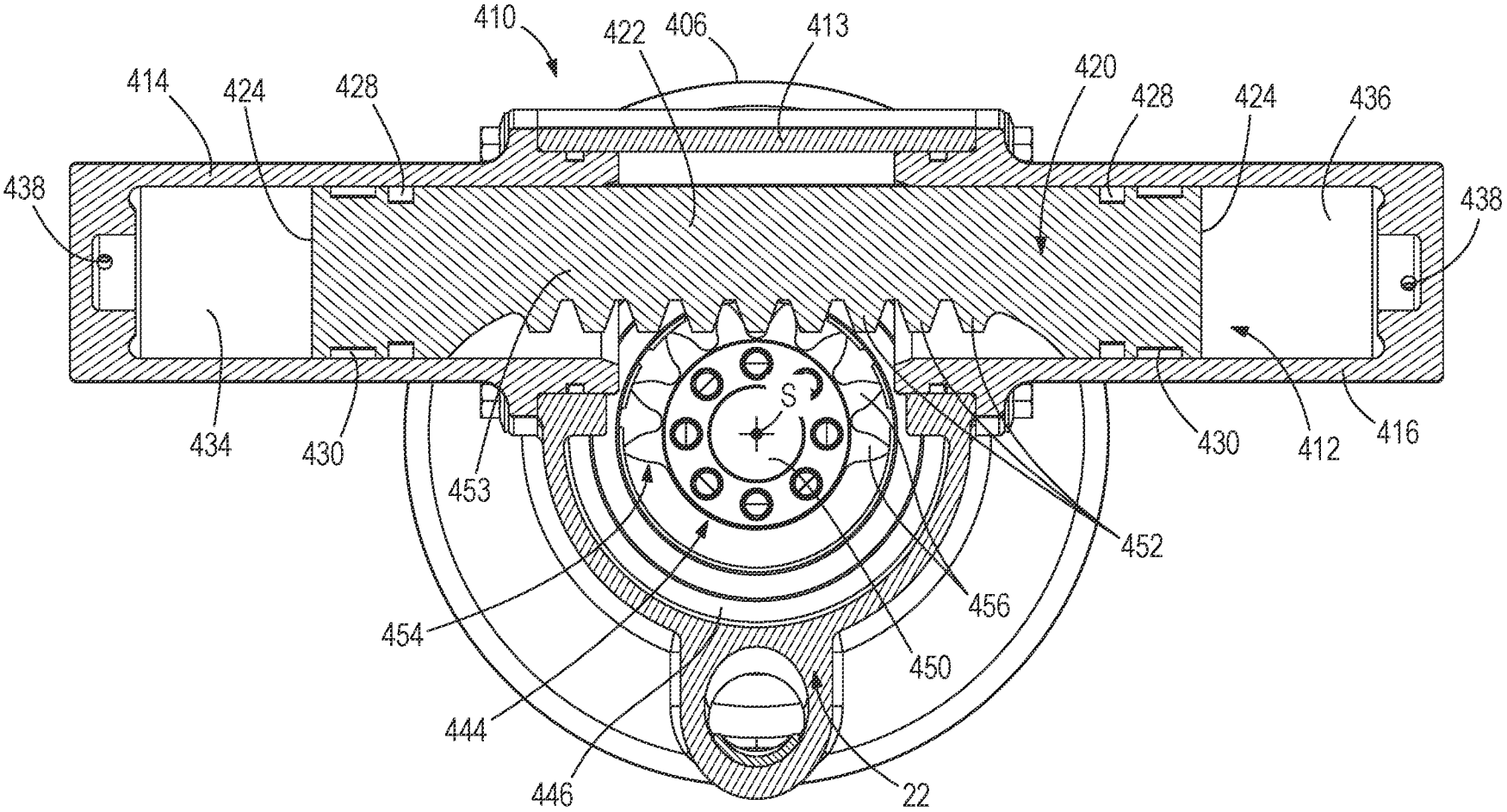
FIG. 16 is a view of section 16-16, taken in FIG. 14.

Referring to FIGS. 15 and 16, the steering actuator 410 is a hydraulically actuated mechanism positioned on the lower driveshaft housing portion 406. The steering actuator 410 includes a piston cylinder 412 that is positioned on the front side of the lower driveshaft housing portion 406 and extends laterally from the port side to the starboard side of the stern drive 12. In the illustrated embodiments the piston cylinder 412 includes a middle cylinder section 413 that is formed in the lower driveshaft housing portion 406 and opposing port and starboard cylinder extensions 414, 416 that are coupled to the port and starboard sides of the driveshaft housing 22 with fasteners 418. A rack 420 is slidably received in the piston cylinder 412 and includes a generally cylindrical body 422 that extends between opposing ends 424 thereof. Each end 424 of the rack 420 includes annular grooves 426 formed around the body 422 that are configured to receive a radially outer seal 428 (i.e., an O-ring) and/or a slide bearing 430 (FIG. 16). When the rack 420 is positioned in the piston cylinder 412, the radially outer seals 428 form a seal with the radially inner sidewalls of the piston cylinder 412 and define a port side chamber 434 and a starboard side chamber 436 within the piston cylinder 412. The port and starboard cylinder extensions 414, 416 each include an inlet 438 through which hydraulic fluid may be pumped into the port and/or starboard chambers 434, 436.

In the illustrated embodiments, hydraulic fluid may be pumped into or out of the steering actuator 410 from a conventional hydraulic manifold 411 including a conventional hydraulic fluid pump and control valves (FIG. 14) configured to supply hydraulic fluid to the piston cylinder 412. The rack 420 is configured to slide back and forth in the piston cylinder 412 under pressure provided by hydraulic fluid which is selectively pumped into the port and/or starboard chambers 434, 436. The hydraulic manifold 411 may be positioned in the marine vessel and is connected to the inlets 438 on the cylinder extensions 414, 416 via conduits 440 (see FIG. 14) that extend from ports 441 in the cylinder extensions 414, 416 to the hydraulic manifold 411. The conduits may extend over the transom 18 and mounting assembly 16 into the marine vessel. Some embodiments, however, may be configured with a different arrangement for connecting the steering actuator 410 to a hydraulic manifold 411. For example, as discussed below in reference to FIGS. 23-28, at least a portion of a hydraulic supply line may extend through the mounting assembly 16 and/or the driveshaft housing 22. The supply of pressurized hydraulic fluid from the manifold 411 to the piston cylinder 412 can be controlled by a conventional valve arrangement and a conventional operator input device for controlling steering movement of the marine drive.

Referring to FIGS. 15 and 16, the gearcase 26 includes a steering housing 444 that is arranged concentrically with the steering axis S and extends upwards into the driveshaft housing 22. The illustrated steering housing 444 is configured to be coupled to a body of the gearcase 26 at a flange 446 formed around the lower end of the steering housing 444 such that the rotational position of the steering housing 444 is fixed relative to the body of the gearcase 26. A steering column 448 extends upwards from the lower end of the steering housing 444 to the upper end thereof. A through bore 450 concentric with the steering axis S extends through the steering housing 444, and the driveshaft 24 is configured to extend through the through bore 450 from the universal joint 50 to the angle gearset 36 in the torpedo housing 34.

In the illustrated embodiments, the steering actuator 410 is operatively engaged with the steering housing 444 by a gearset configured as a rack and pinon gearset. The rack 420 includes a plurality of teeth 452 extending along a rear-facing side 453 of the rack 420. The steering housing 444 includes a kingpin 454 formed around the steering column 448 between the upper and lower ends thereof. The illustrated kingpin 454 includes a plurality of teeth 456 that are arranged radially around the steering column 448 and configured to mesh with and engage the teeth 452 on the rack 420. The sets of teeth 452, 456 are meshed together so that back-and-forth movement of the rack 420 within the piston cylinder 412 causes the teeth 452 on the rack 420 to move the teeth 456 of the kingpin 454. The back-and-forth movement of the rack 420 causes corresponding back-and-forth rotational movement of the steering housing 444 and the gearcase 26 about the steering axis S. Thus, operation of the steering actuator 410 causes steering housing 444 to rotate with the gearcase 26 about the steering axis S with respect to the steering housing 32 and powerhead 14, thereby steering the gearcase 26 relative to the driveshaft housing 22.

In the illustrated embodiments, the kingpin 454 includes gear teeth 456 that are formed 180 degrees around the steering column 448. Thus, the gearcase 26 has a steering range of 180 degrees and can be rotated 90 degrees clockwise and counterclockwise about the steering axis S relative to a straight-ahead position. Some embodiments, however, may be configured with a steering range that is more than 180 degrees or less than 180 degrees. For example, a stern drive 12 can be configured with a kingpin having teeth formed 120 degrees around the steering column to provide a steering range of 120 degrees (60 degrees clockwise and counterclockwise relative to a straight-ahead orientation).

Hydraulic connectors extending from a marine vessel to a stern drive supported on the vessel are often subject to bending and/or abrasion which may damage the connectors over extended periods of time. For stern drives that require large diameter hydraulic connectors or a plurality of hydraulic connectors, the rigidity of these connectors may interfere with the steering and trimming of the marine drive. Lengthy connectors extending between the stern drive and the marine vessel can affect the styling of the marine drive and can otherwise be inconvenient for a number of reasons. Through research and experimentation, the present inventors determined it would be advantageous to provide a hydraulic supply line that is concealed and integrated into the mounting assembly and/or drive assembly of a stern drive. The present disclosure is a result of the present inventors' efforts in this regard.

Referring to FIGS. 23-28, some embodiments of a stern drive 12 may be configured with a novel mounting assembly 16 and trim joint 710 including an integrated hydraulic supply line 706 configured to transport hydraulic fluid through fluid passages 720, 750, 780 in the mounting assembly 16 and/or trim joint 710 between the hydraulic pump 411 and the steering actuator 410 on the lower portion 406 of the driveshaft housing 22. The stern drive 12 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. The trim joint 710 is generally symmetrical in the lateral direction LA, so that the components on the port side of the trim joint 710 are the same as or are mirror images of the components on the starboard side of the trim joint. As such, the descriptions provided below regarding components on one side of the trim joint 710 equally apply to the components on the opposite side of the trim joint 710.

Figure 14:
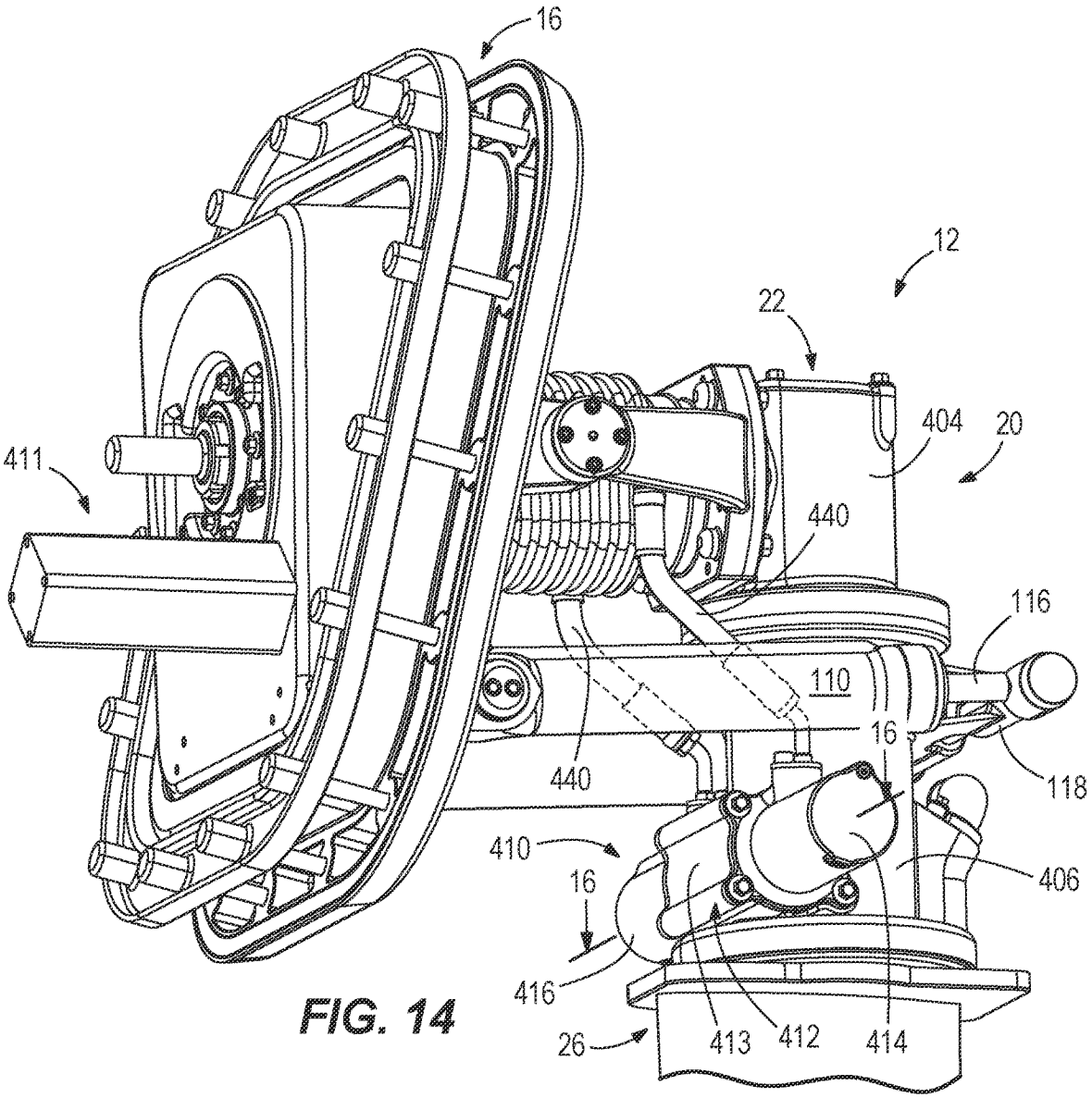
FIG. 14 is a starboard side perspective view of a stern drive including a steering actuator.

Similar to the embodiments of FIGS. 14-16, the stern drive 12 of FIGS. 23-28 includes a drive assembly 20 that is supported on the transom 18 of the marine vessel by a mounting assembly 16. The drive assembly 20 is configured to support a propulsor 30 for generating a thrust force in water and includes the powerhead 14, a driveshaft housing 22, and a gearcase 26 suspended from the driveshaft housing 22. The driveshaft housing 22 includes an upper housing portion 404 which houses the angle gearset 72 that couples the universal joint 50 to the driveshaft 24 and a lower housing portion 406 which is coupled to the second ends 116 of the trim cylinders 110 at the second pivot joints 118 on the port and starboard sides of the lower driveshaft housing portion 406. The gearcase 26 is steerable about a steering axis S relative to the driveshaft housing 22, and a steering actuator 410 on the driveshaft housing 22 is configured to steer the gearcase 26 relative to the driveshaft housing 22.

The mounting assembly 16 includes a rigid mounting plate 100 configured to support at least some of the various components of the drive assembly 20 on the transom 18 on the marine vessel. The rigid mounting plate 100 is recessed into the hull of the marine vessel and includes an interior space with a forward wall 150, a rear opening defined by an annular flange 154, and sidewalls 156 that extend longitudinally between the forward wall 150 and the annular flange 154. The drive assembly 20 is supported on the rigid mounting plate 100 via a port side rigid mounting arm **104*a* and a starboard side rigid mounting arm 140*b* that extend rearwardly from the forward wall 150 of the rigid mounting plate 100. The rigid mounting arms 104 are pivotably coupled to a rigid, U-shaped mounting bracket 108 of the driveshaft housing 22 that extends forwardly from the upper portion 404 of the driveshaft housing 22. The port and starboard rigid mounting arms 104*a*, 104*b* are coupled to respective port and starboard mounting bracket arms 109*a*, 109*b* of the mounting bracket 108 at a trim joint 710 that defines a trim axis T about which the drive assembly 20 is trimmable up and down relative to the mounting assembly 16**.

The stern drive 12 of FIGS. 23-28 is configured with a hydraulic steering actuator 410 similar to that of FIGS. 14-16. A hydraulic pump 411 is configured to pump a hydraulic fluid to and/or from the steering actuator 410 via the trim joint 710 and passages 720, 750 which are entirely contained within the drive assembly 20 and/or the mounting assembly 16. As previously discussed in reference to FIGS. 14-16, the steering actuator includes a hydraulic cylinder 412 on the driveshaft housing 22, and the gearcase 26 includes a steering housing 444 which extends into the driveshaft housing 22. The steering actuator 410 includes a rack 420 on the gearcase 26 and a kingpin 454 on the steering housing 444. The rack 420 is positioned in the hydraulic cylinder 412 and is movable back and forth in the cylinder 412 to steer the gearcase 26 relative to the driveshaft housing 22. Movement of the rack 420 rotates the kingpin 454 and thereby steers the gearcase 26 relative to the driveshaft housing 22. Some embodiments, however, may include a differently configured hydraulic steering actuator.

Figure 26:
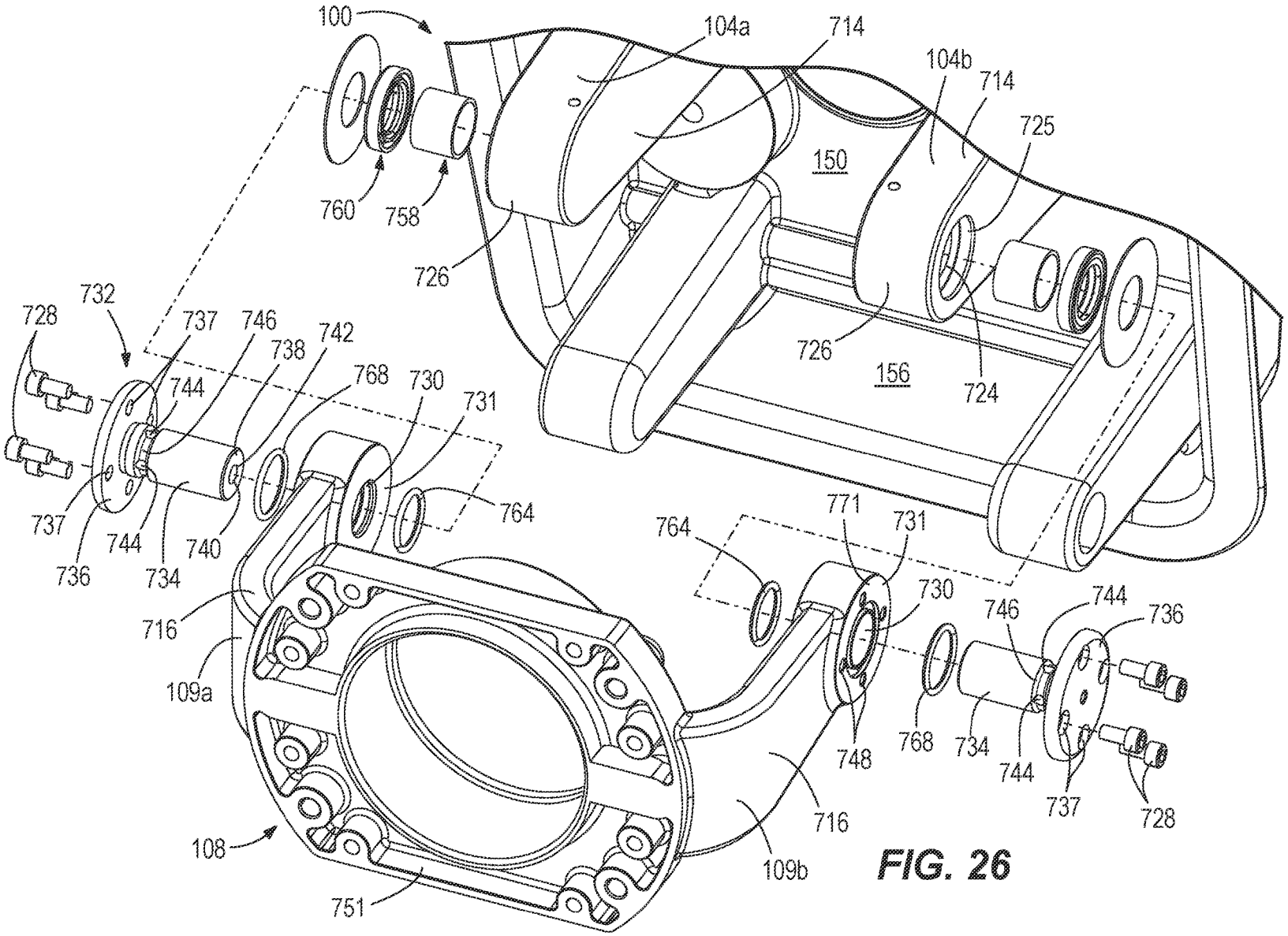
FIG. 26 is an exploded perspective view of the trim joint of FIG. 25.

Referring to FIG. 26, the port and starboard sides of the trim joint 710 include a stationary member 714 (e.g., the rigid mounting arms 140*a*, 104*b*) and a rotary member 716 (e.g., the mounting bracket arms 109*a*, 109*b*), and the hydraulic fluid is conveyed through the stationary members 714 and through the rotary members 716 via internal passages 720. 750. In the illustrated embodiments, the stationary members 714 are on the mounting assembly 16 and the rotary members 716 are on the driveshaft housing 22. Some embodiments, however, may be configured with the stationary members 714 on the driveshaft housing 22 and the rotary members 716 on the mounting assembly 16.

Figure 24:
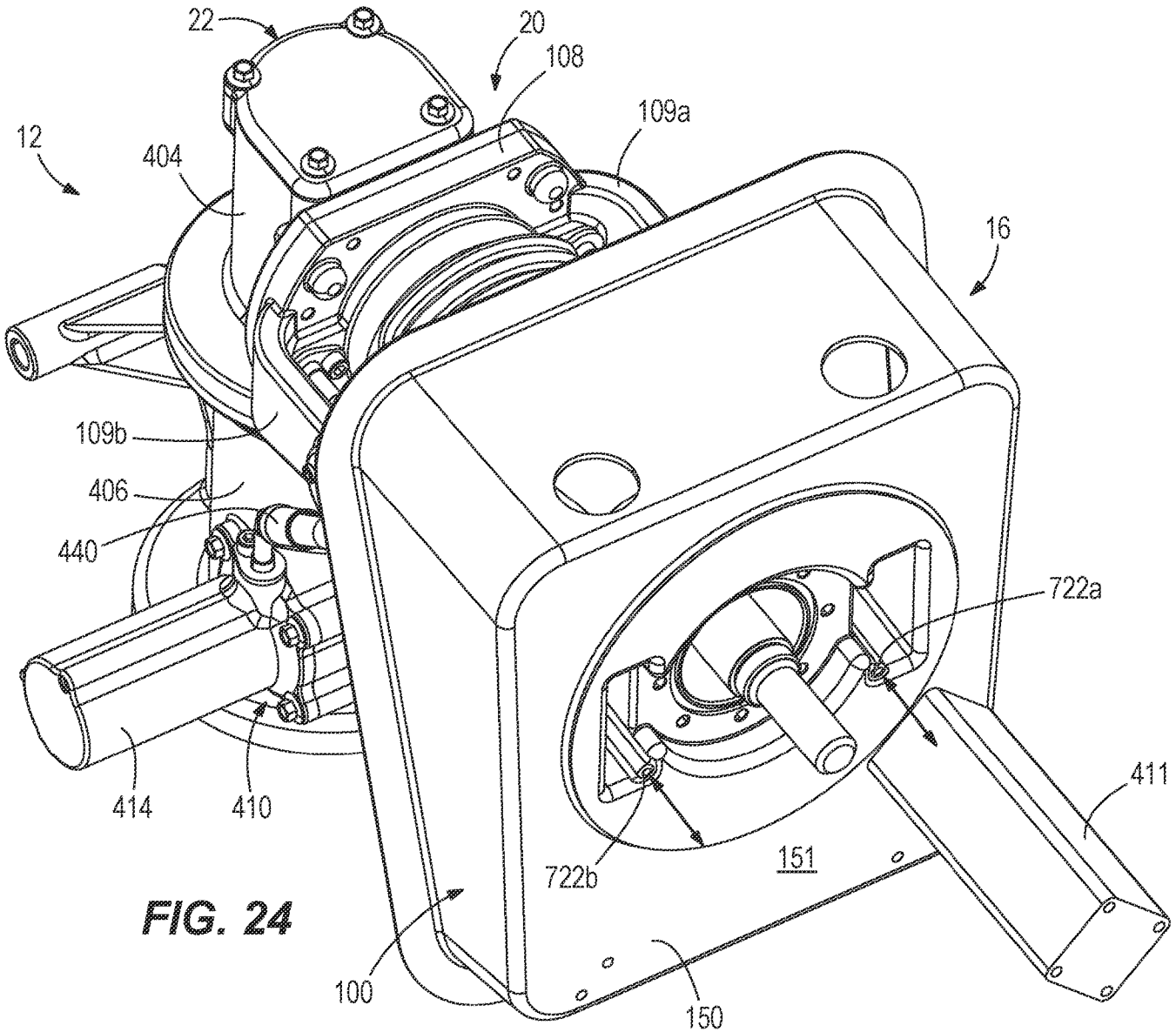
FIG. 24 is another starboard side perspective view of the stern drive of FIG. 23.
Figure 25:
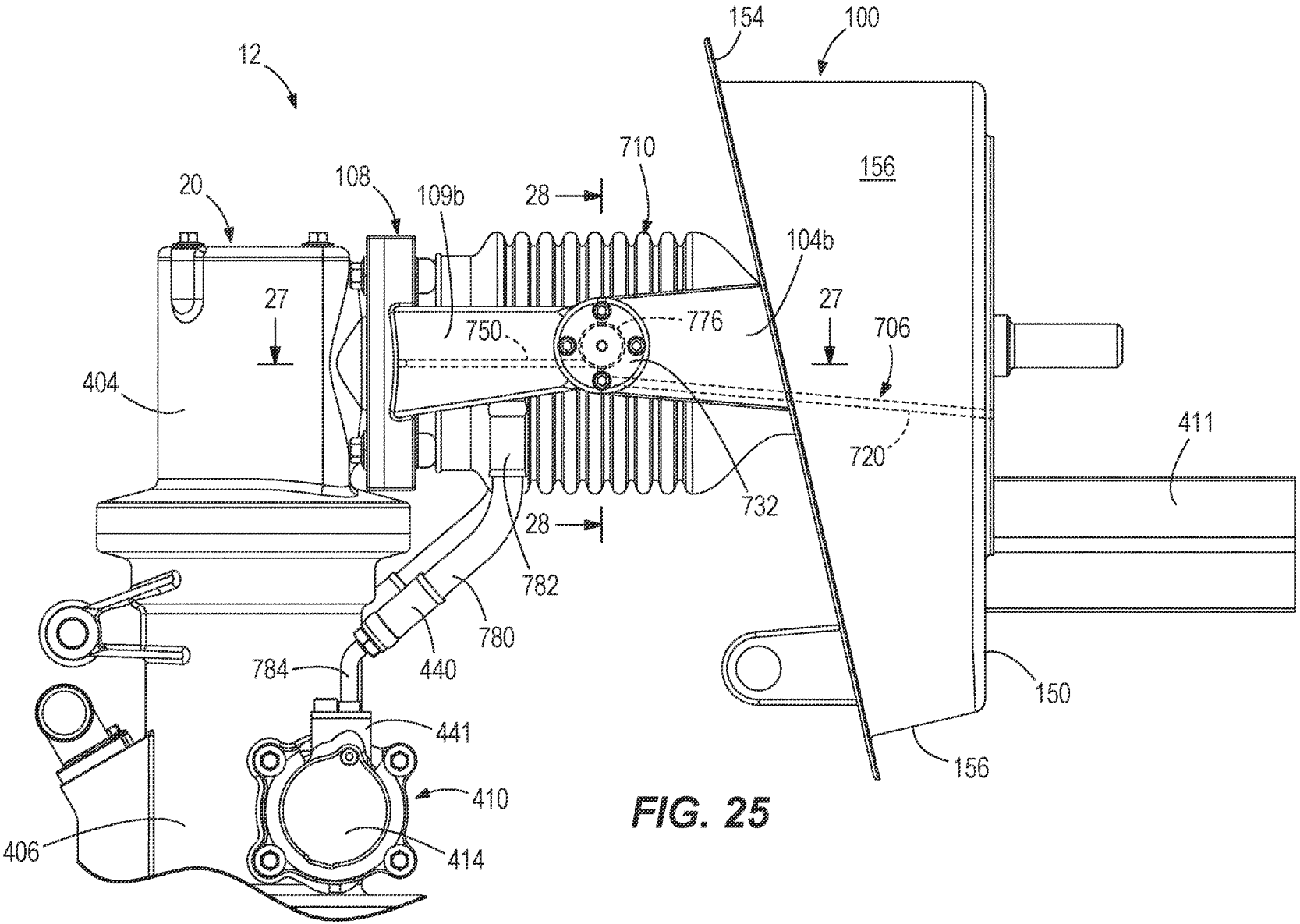
FIG. 25 is a starboard side view of the stern drive of FIG. 24.

On the port and starboard sides, the hydraulic supply line 706 includes a first fluid passage 720 that extends through the mounting assembly 16 and the stationary member 714. As illustrated in FIGS. 24 and 25, the first fluid passages 720 each have an inlet 722 on the front surface 151 of the front wall 150 of the rigid mounting plate 100. The inlets 722 may be connected to the hydraulic pump 411, which is mounted on an opposite side of the mounting assembly 16 relative to the drive assembly 20 such that the hydraulic pump 411 is located in the marine vessel and the drive assembly 20 is located outside of the marine vessel. The first fluid passages 720 extend from the corresponding inlet 722, through the rigid mounting plate 100 and the rigid mounting arms 104 arms, and to the trim joint 710.

Figure 27:
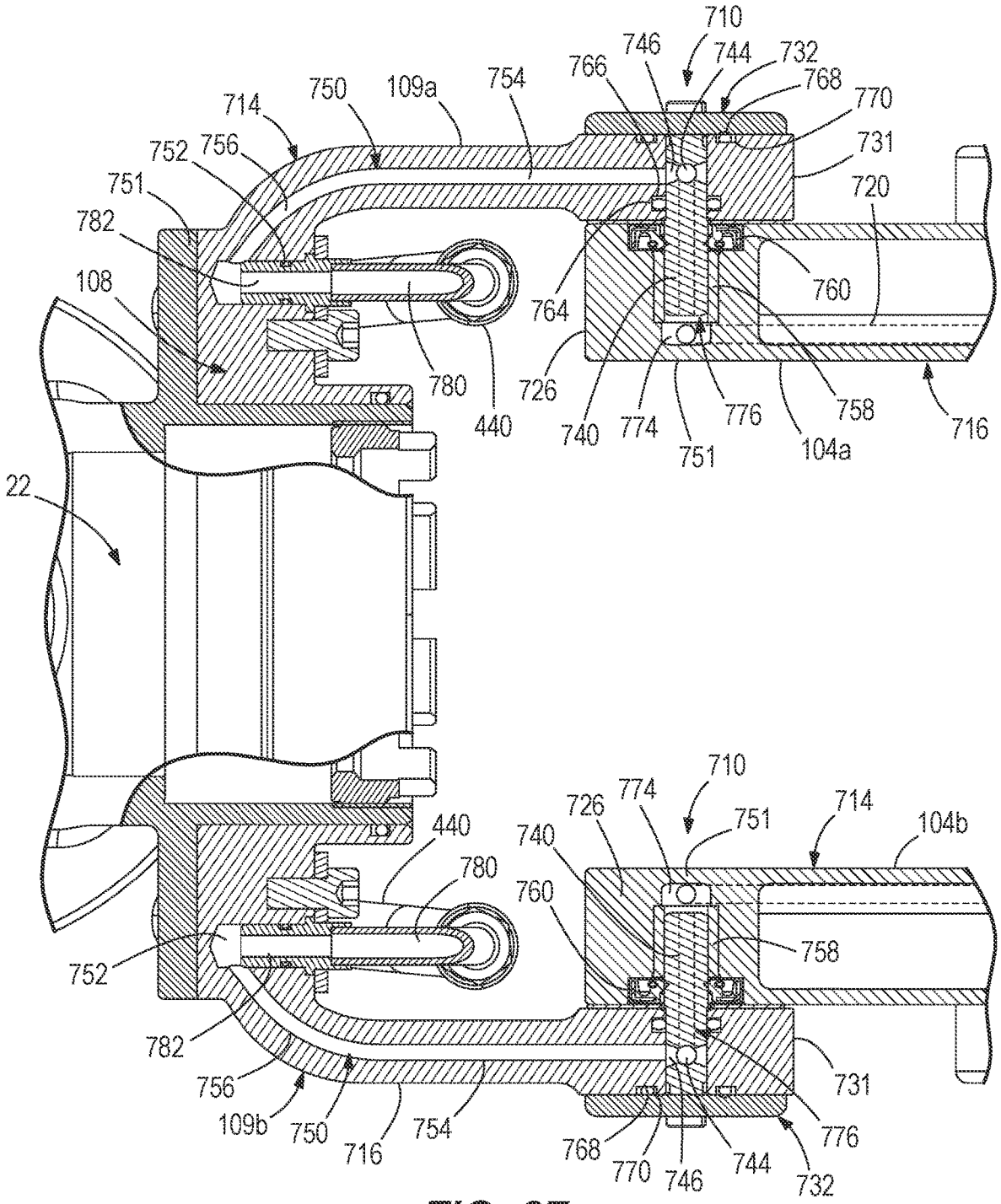
FIG. 27 is a view of section 27-27, taken in FIG. 25.

Referring to FIGS. 26 and 27, the first fluid passages 720 through the mounting assembly extend through the mounting arms 104 to cavities 724 of the trim joint 710, which are positioned at the distal ends 726 of the stationary members 714 (i.e., mounting arms 104) in the illustrated embodiments. The cavities 724 are generally cylindrical and include an openings 725 that face laterally outward away from each other. The cavities 724 are configured to rotatably receive a corresponding part of the rotary member 716 (i.e., the pin member 732) such that the cavities 724 define the trim axis T about which the drive assembly 20 is pivoted.

The rotary members 716 are configured as the port and starboard mounting bracket arms 109*a*, 109*b* of the U-shaped bracket 108. A lateral through bore 730 is formed through the distal ends 731 of the rotary members 716 and is configured to receive a pin member 732 that couples the rotary members 716 to the stationary members 714. Referring to FIG. 27, the driveshaft housing 22 includes second fluid passages 750 in the rotary members 716. Each second fluid passage 750 extends through the port or starboard mounting bracket arm 109*a*, 109*b* from the through bore 730 at the trim joint 710 to an outlet port 752 proximate a back end 751 of the U-shaped bracket 108. The second passages 750 generally follow the curvature of the mounting bracket arms 109 and include a linear segment 754 that extends longitudinally from the through bores 730 towards the driveshaft housing 22 and a curved segment 756 that turns laterally inward to the outlet port 752 proximate back end 751 of the U-shaped bracket 108.

Figure 28:
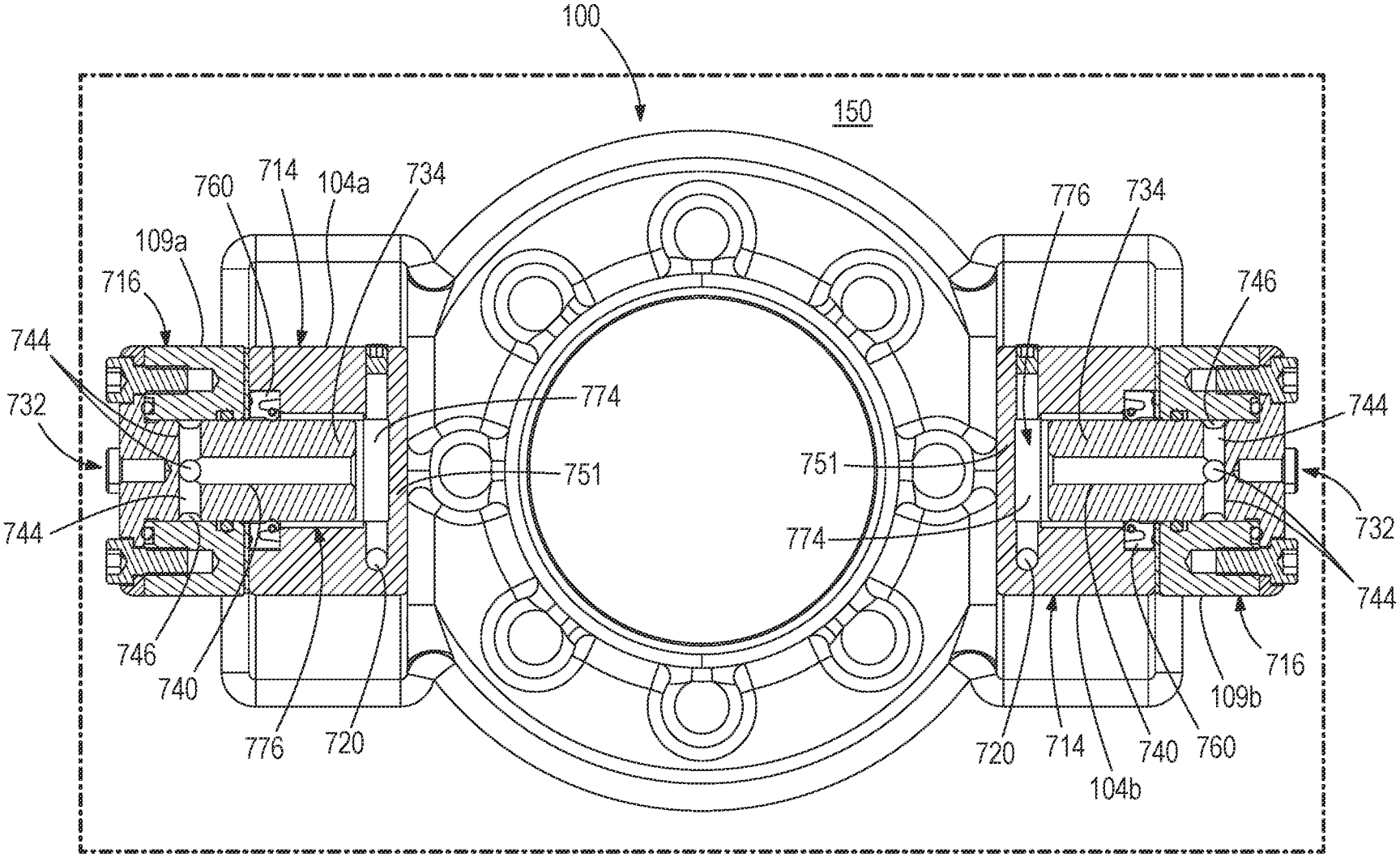
FIG. 28 is a view of section 28-28, taken in FIG. 25.

Referring to FIGS. 26-28, the pin members 732 each have a generally cylindrical stem 734 that extends from a flange 736 to an opposing end 738 thereof. An axial chamber 740 extends through the stem 734 from an inlet 742 at the end 738 of the stem 734 towards the flange 736. Proximate the flange 736, the pin member 732 includes at least one radial bore 744 that extends radially outward from the axial chamber 740 to an annular passage 746 formed around the stem 734. In the illustrated embodiments, the pin members 732 each include four radial bores 744 that are spaced around the stem 90 degrees apart from each other. Some embodiments, however, may have a different number of radial bores, at least one of which may not be evenly spaced around the stem.

The stem 734 of each pin member 732 is configured to extend through the lateral through bore 730 in the rotary member 716 and into the cavity 724 on the corresponding stationary member 714 such that the stem 734 is rotatable within the cavity 724. Openings 737 formed in the flange 736 are configured to receive fasteners 728 that couple the pin member 732 to corresponding openings 748 formed around the through bore 730, thereby securing the pin member 732 to the rotary member 716 such that the pin member 732 and the rotary member 716 rotate together about the trim axis T. The stems 734 of the pin members 732 are supported in the cavities 724 in the stationary members 714 by bushings 758, which may reduce the friction between the stems 734 and the inner diameter of the cavities 724 such that the pin members 732 may rotate relative to the stationary members 714. An annular seal member 760 extends around each stem 734 and seals the outer diameter surface of the stem 734 to an inner diameter surface of the cavity 724.

In the illustrated embodiment, the trim joint 710 includes two seal members 764, 768 configured to form a seal between the rotary members 716 and the pin members 732. A first seal member 764 is positioned in an annular groove 766 formed around the interior diameter of the through bore 730 extending through each stationary member 714. The first seal members 764 forms a seal between the outer diameter of the stem 734 and the inner diameter of the through bore 730. The second seal member 768 is positioned in a circular groove 770 formed on a laterally outward facing surface 771 of the rotary member 716 around the through bore 730. The second seal member 768 forms a seal between the laterally outward facing surface 771 and flange 736 on the pin member 732.

With the pin members 732 rotatably coupling the port rigid mounting arm 104*a* to the port mounting bracket arm 109*a* and the starboard rigid mounting arm 104*b* to the starboard mounting bracket arm 109*b*, the rotary members 716 are coupled to the stationary members 714, thereby securing the drive assembly 20 to the mounting assembly 16.

As illustrated in FIGS. 27 and 28, the cavities 724 and/or the stems 734 of the pin members 732 are dimensioned so that a void 774 is present between the end 738 of the pin members and the back walls 725 of the cavities 724. The voids 774 are in fluid communication with the first fluid passages 720 such that hydraulic fluid may flow into the axial chambers 740 extending through the stems 734 of the pin members 732. The annular passages 746 formed around the stems 734 are in fluid communication with the second passages 750 such that hydraulic fluid may flow through axial chambers 740 into the second passages 750 via the radial bores 744 and the annular passage 746. Thus, on the port and starboard sides of the trim joint 710, the void 774, the axial chamber 740, the radial bores 744 and the annular passage 746 form a chamber 776 in the trim joint 710 which fluidly couples the first fluid passage 720 and the second fluid passage 750.

Figure 23:
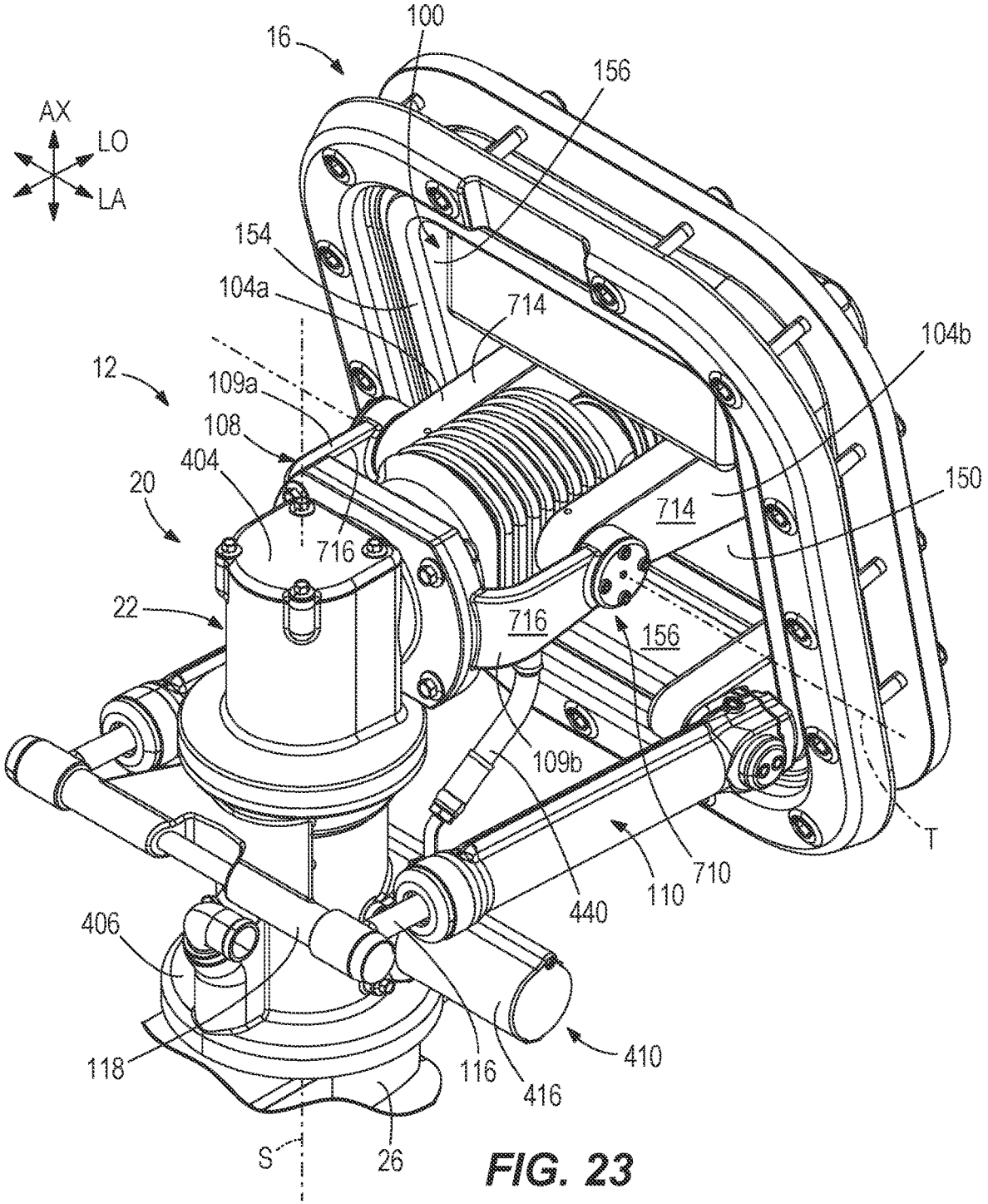
FIG. 23 is a starboard side perspective view of another example of a stern drive including a hydraulic steering actuator and a trim joint.

Hydraulic fluid may be pumped from each second fluid passage 750 to the steering actuator 410 via corresponding third passages 780 on the port and starboard sides of the stern drive 12. Referring to FIGS. 23. 25, and 27, the illustrated third passages 780 are configured as conduits 440 extending between the outlets 752 of the second passages 750 to a cylinder inlet port 441 on the corresponding one of the port and starboard cylinder extensions 414, 416. Each conduit 440 has a first end 782 that is received in one of the outlets 752 of the second passages 750 and a second end 784 that is received in one of the cylinder ports 441. The conduit 440*a* on the port side of the stern drive 12 extends from the port side outlet 752*a* in the port side mounting bracket arm 109*a* to the cylinder inlet 411*a* on the port cylinder extension 414. The conduit 440*b* on the starboard side of the stern drive 12 extends from the starboard side outlet 752*b* in the starboard side mounting bracket arm 109*b* to the cylinder inlet 411*b* on the starboard cylinder extension 416. Since the U-shaped mounting bracket 108 of the driveshaft housing 22 does not move relative to the steering actuator 410 as the drive assembly 20 is trimmed up or down, the conduits 440 do not bend as the drive assembly 20 is trimmed. This may be useful, for example, in order to reduce wear on the conduits by limiting their motion and preventing the conduits from abrasively rubbing against another component of the stern drive 12. Some embodiments, however, may include a differently configured third passage. For example, the drive assembly may include a third fluid passage that extends entirely through the driveshaft housing 22.

To steer the stern drive 12, an operator may use the input device to control the hydraulic pump 411 to supply pressurized hydraulic fluid to the steering actuator 410 via the passages 720, 750, 780 extending through the mounting assembly 16, trim joint 710, and driveshaft housing 22. To rotate the gearcase 26 into a starboard orientation to conduct a turn towards the port side of the marine vessel, pressurized hydraulic fluid is supplied to the port side chamber 434 via the port side hydraulic supply line 706. The hydraulic pump 411 pumps hydraulic fluid into the port side inlet 722 and through the port side rigid mounting arm 104*a* via the first passage 720 and into the chamber 776 in the trim joint 710. The hydraulic fluid passes through the chamber 776 in the trim joint 710 (i.e., through the void 774, the axial chamber 740 of the pin member 732, the radial bore(s) 744, and the annular passage 746) and into the second passage 750 in the port side mounting bracket arm 109*a*. The hydraulic fluid then flows through the second passage 750, out the corresponding outlet 752 on the U-shaped mounting bracket 108, and through the conduit 440 to the cylinder inlet port 441 on the port cylinder extension 414. Hydraulic fluid entering the port cylinder extension 414 forces the rack 420 to slide in the starboard direction and into the starboard cylinder extension 416. As the rack 420 moves in the starboard direction, the teeth 452 on the rack 420 push against the teeth 456 on the kingpin 454 to rotate the steering housing 444 and gearcase 26 into a starboard-facing orientation so that the thrust force generated by the propulsors 30 turns the marine vessel in the port direction.

To rotate the gearcase 26 into a port orientation to conduct a turn towards the starboard side of the marine vessel, pressurized hydraulic fluid is supplied to the starboard side chamber 436 via the starboard side hydraulic supply line 706. The hydraulic pump 411 pumps hydraulic fluid into the starboard side inlet 722 and through the starboard side rigid mounting arm 104*b* via the first passage 720 and into the chamber 776 of the trim joint 710. The hydraulic fluid passes through the chamber 776 in the trim joint 710 (i.e., through the void 774, the axial chamber 740 of the pin member 732, the radial bore(s) 744, and the annular passage 746) and into the second passage 750 in the starboard side mounting bracket arm 109*b*. The hydraulic fluid then flows through the second passage 750, out the corresponding outlet 752 on the U-shaped mounting bracket 108, and through the conduit 440 to the cylinder inlet port 441 on the starboard cylinder extension 416. Hydraulic fluid entering the starboard cylinder extension 416 forces the rack 420 to slide towards the port side and into the port cylinder extension 414. As the rack 420 slides in the port direction, the teeth 452 on the rack 420 push against the teeth 456 on the kingpin 454 to rotate the steering housing 444 and gearcase 26 into a port-facing orientation so that the thrust force generated by the propulsors 30 turns the marine vessel in the starboard direction.

Some embodiments can be configured to pump hydraulic fluid into and/or from both ends of the hydraulic cylinder 412 when steering the gearcase 26. For example, when turning the marine vessel in the port direction, the hydraulic pump 411 may pump fluid into the starboard cylinder extension 416 to push the rack 420 while simultaneously drawing hydraulic fluid out of the port cylinder extension 414 to pull on the rack 420 from the opposite end. Similarly, when turning the marine vessel in the starboard direction, the hydraulic pump 411 may pump fluid into the port cylinder extension 414 to push the rack 420 while simultaneously drawing hydraulic fluid out of the starboard cylinder extension 416 to pull on the rack from the opposite end.

Figure 17:
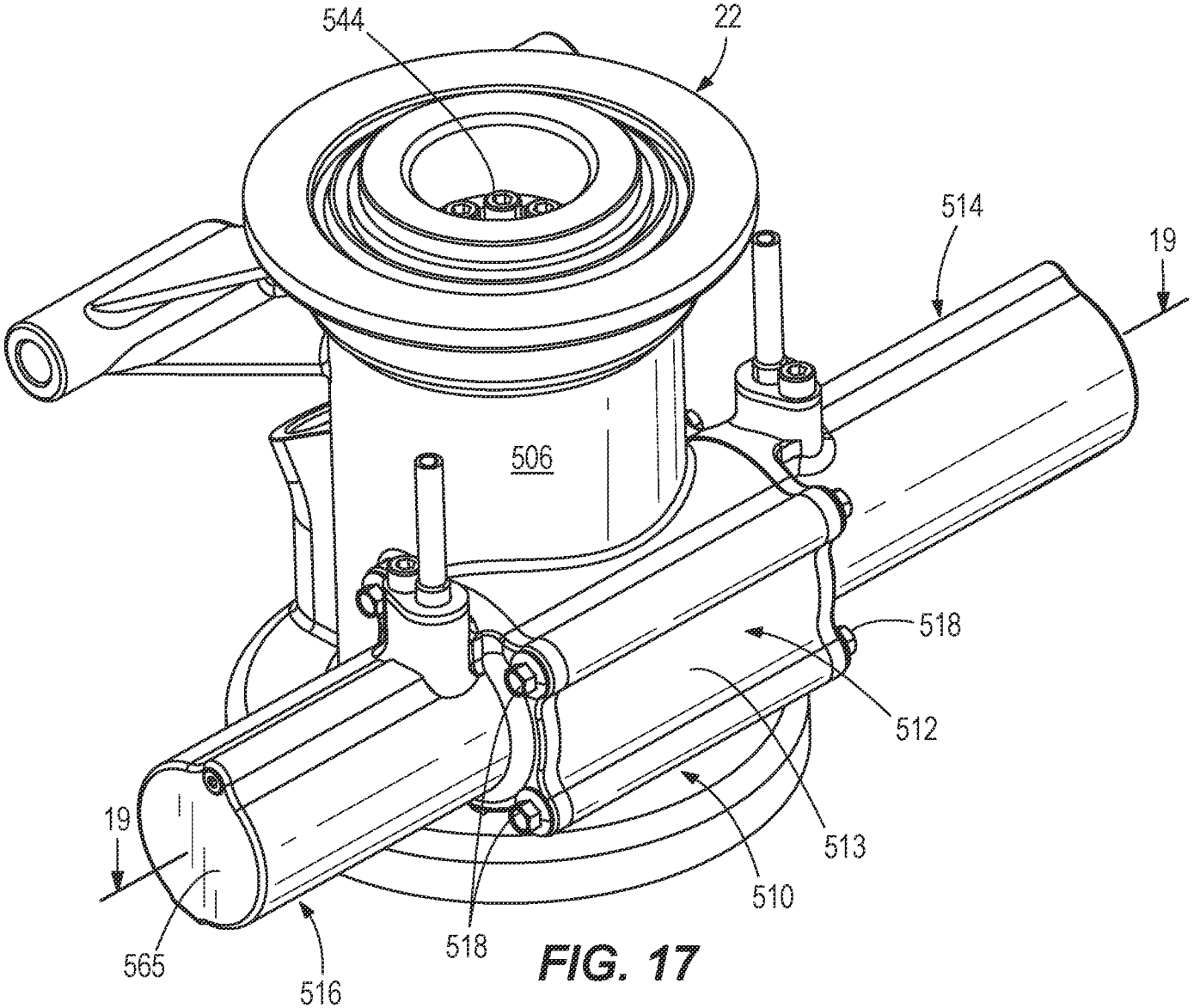
FIG. 17 is a port side perspective view of another example of the gearcase and steering actuator for a stern drive.
Figure 18:
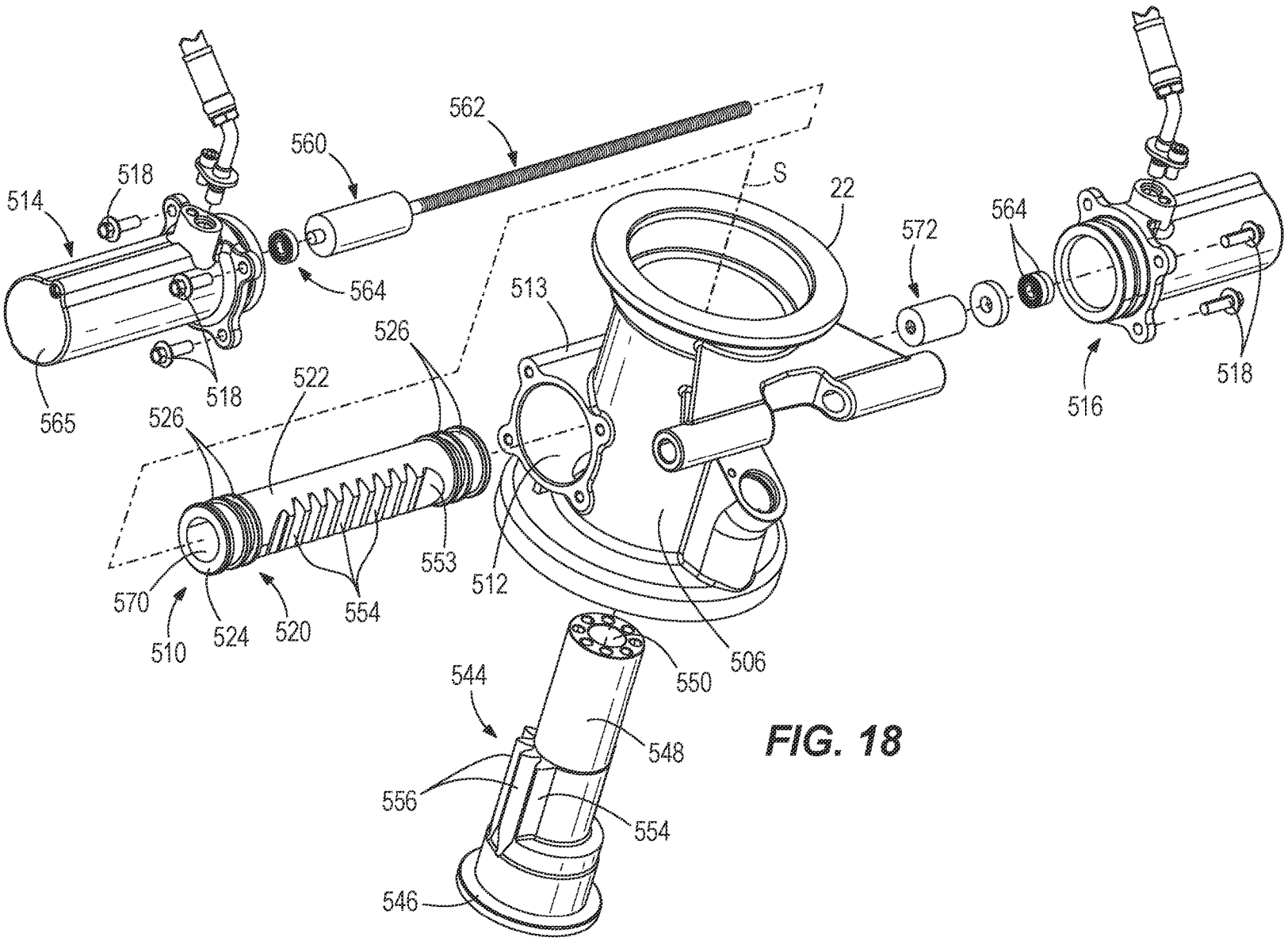
FIG. 18 is an exploded perspective view of the gearcase and steering actuator of the stern drive of FIG. 17.
Figure 19:
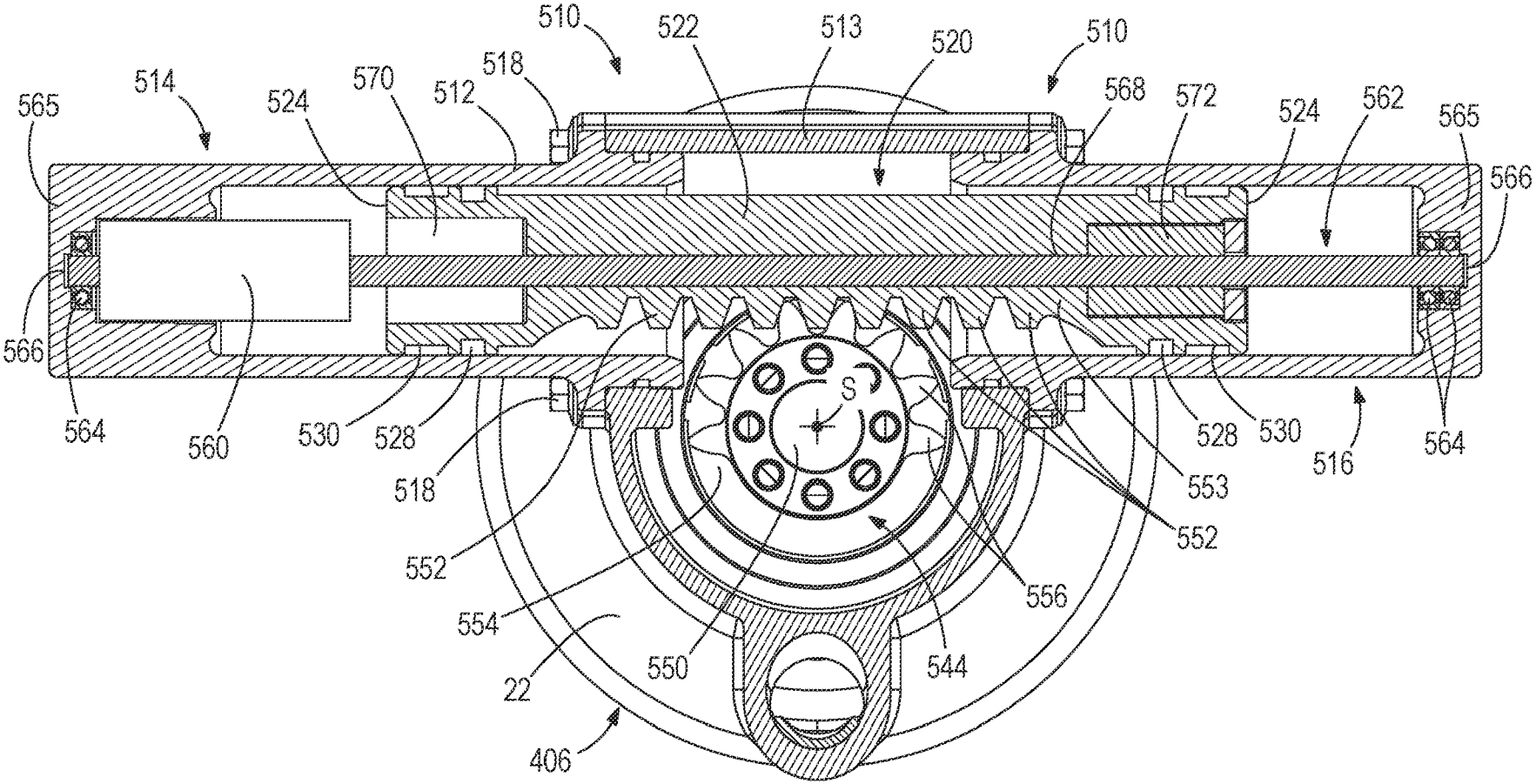
FIG. 19 is a view of section 19-19, taken in FIG. 17.

Referring to FIGS. 17-19, some embodiments of a stern drive may be configured with an electrically actuated steering actuator 510. Similarly to the steering actuator 410 of FIGS. 14-16, the steering actuator 510 of FIGS. 17-19 is operatively engaged with the gearcase 26 by a gearset configured as a rack and pinon gearset. A piston cylinder 512 is positioned on the front side of the gearcase 26 and includes a middle cylinder section 513 formed in the lower driveshaft housing portion 506 and opposing port and starboard cylinder extensions 514, 516 that are coupled to sides of the driveshaft housing 22 with fasteners 518. A rack 520 is slidably received in the piston cylinder 512 and includes a generally cylindrical body 522 with a plurality of gear teeth 552 formed along a rear-facing side 553 of the body 522. In some embodiments, each end 524 of the rack 520 includes annular grooves 526 formed around the body 522 that are configured to receive a radially outer seal 528 (i.e., an O-ring) that forms a seal with the interior of the piston cylinder 512 and/or a slide bearing 530 configured to reduce friction between the rack 520 and the piston cylinder 512 as the rack slides back and forth in the piston cylinder 512. Some embodiments, however, may omit at least one of the radially outer seal 528 and the slide bearing 530.

Referring to FIGS. 18 and 19, the gearcase 26 includes a steering housing 544 that is arranged concentrically with the steering axis S and extends upwards into the driveshaft housing 22. The illustrated steering housing 544 is configured to be coupled to a body of the gearcase 26 at a flange 546 formed around the lower end of the steering housing 544. A steering column 548 extends upwards from the lower end of the steering housing 544. A through bore 450 through which the driveshaft 24 extends is formed axially through the center of the steering column 548, and a kingpin 554 is formed around the steering column 548. The teeth 556 of the kingpin 554 are configured to mesh with the teeth 552 on the rack 520 such that back-and-forth movement of the rack 520 in the piston cylinder 512 causes rotation of the steering housing 544 and the gearcase 26.

The steering actuator 510 includes an electric motor 560 configured to move the rack 520 back and forth in the piston cylinder 512, thereby steering the gearcase 26 relative to the driveshaft housing 22. In the illustrated embodiments, the electric motor 560 is configured as an inline motor positioned in the port cylinder extension 514. Some embodiments, however, may be configured with a different type of electric motor, which may be positioned in the port cylinder extension 514, the starboard cylinder extension 516, and/or another portion of the driveshaft housing 22. A central screw 562 configured to be rotated by the electric motor 560 extends between opposite lateral ends of the piston cylinder 512. Bearings 564 are received in corresponding holes 566 formed in the end surfaces 565 of the cylinder extensions 514, 516 and rotatably support the central screw 562 in the piston cylinder 512. The rack 520 is positioned on the central screw 562, which extends through an axial through bore 568 formed through the body 522 of the rack 520. Counterbored recesses 570 in the axial ends 524 of the rack 520 are configured to receive a screw-type linear actuator nut 572 (e.g., a roller screw nut, ball screw nut, lead screw nut, etc.) that couples the rack 520 to the central screw 562 such that rotation of the central screw 562 causes corresponding sliding movement of the rack 520.

In order to steer the stern drive 12, the electric motor 560 is configured to move the rack 520 in the port or starboard direction to rotate the gearcase 26 about the steering axis S. To turn the marine vessel in the port direction, the electric motor 560 rotates the central screw 562 in a first direction that causes the rack 520 to move in the starboard direction into the starboard cylinder extension 516. As the rack 520 moves in the starboard direction, the teeth 552 on the rack 520 push against the teeth 556 on the kingpin 554 to rotate the steering housing 544 and gearcase 26 into a starboard-facing orientation so that the thrust force generated by the propulsors 30 turns the marine vessel in the port direction. To turn the marine vessel in the starboard direction, the electric motor 560 rotates the central screw 562 in a second direction opposite the first direction, thereby causing the rack 520 to move in a port direction into the port cylinder extension 514. As the rack 520 moves in the port direction, the teeth 552 on the rack 520 push against the teeth 556 on the kingpin 554 to rotate the steering housing 544 and gearcase 26 into a port-facing orientation so that the thrust force generated by the propulsors 30 turns the marine vessel in the starboard direction.

Figure 20:
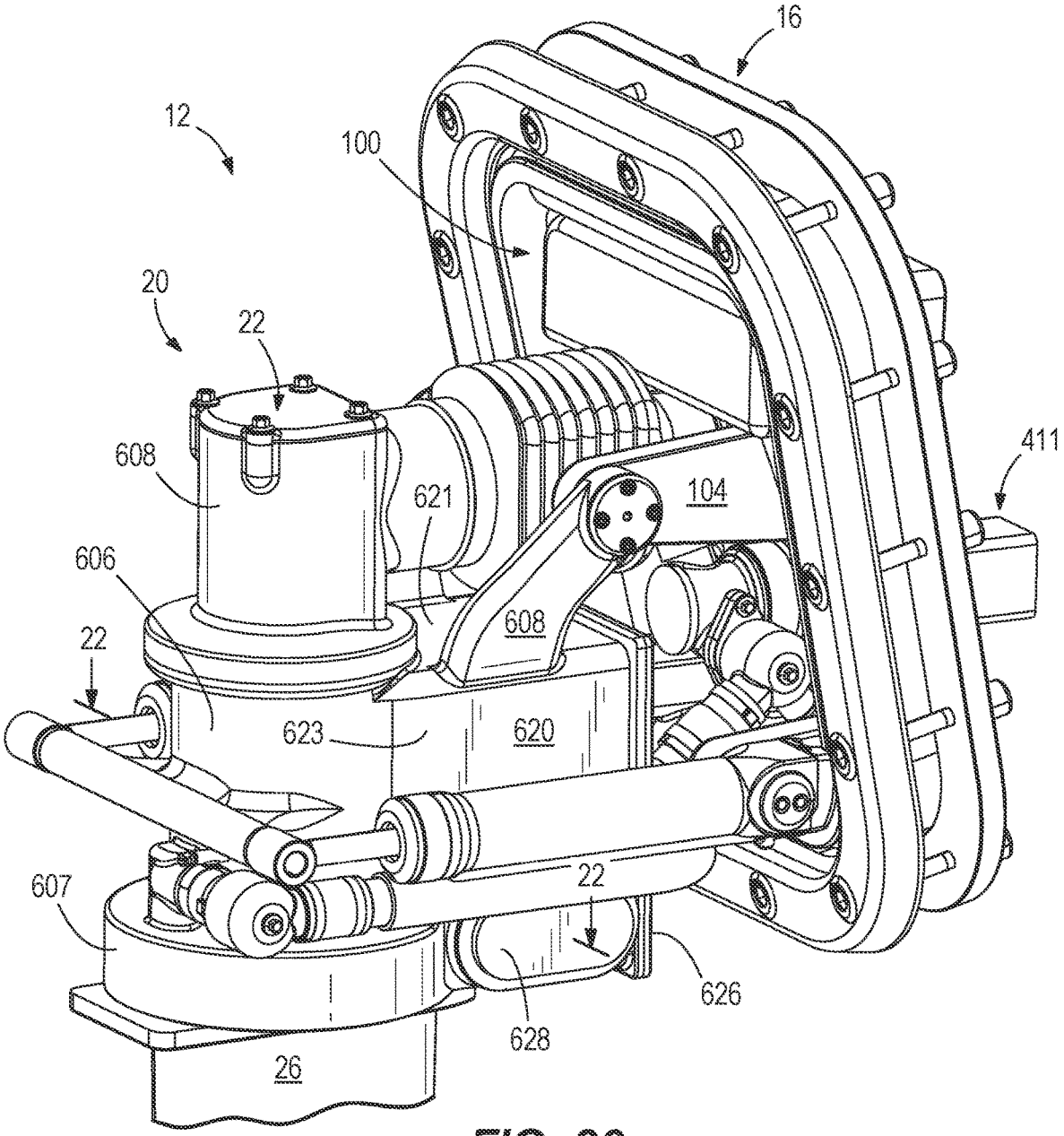
FIG. 20 is a starboard side perspective view of another example of a stern drive including a steering actuator.
Figure 21:
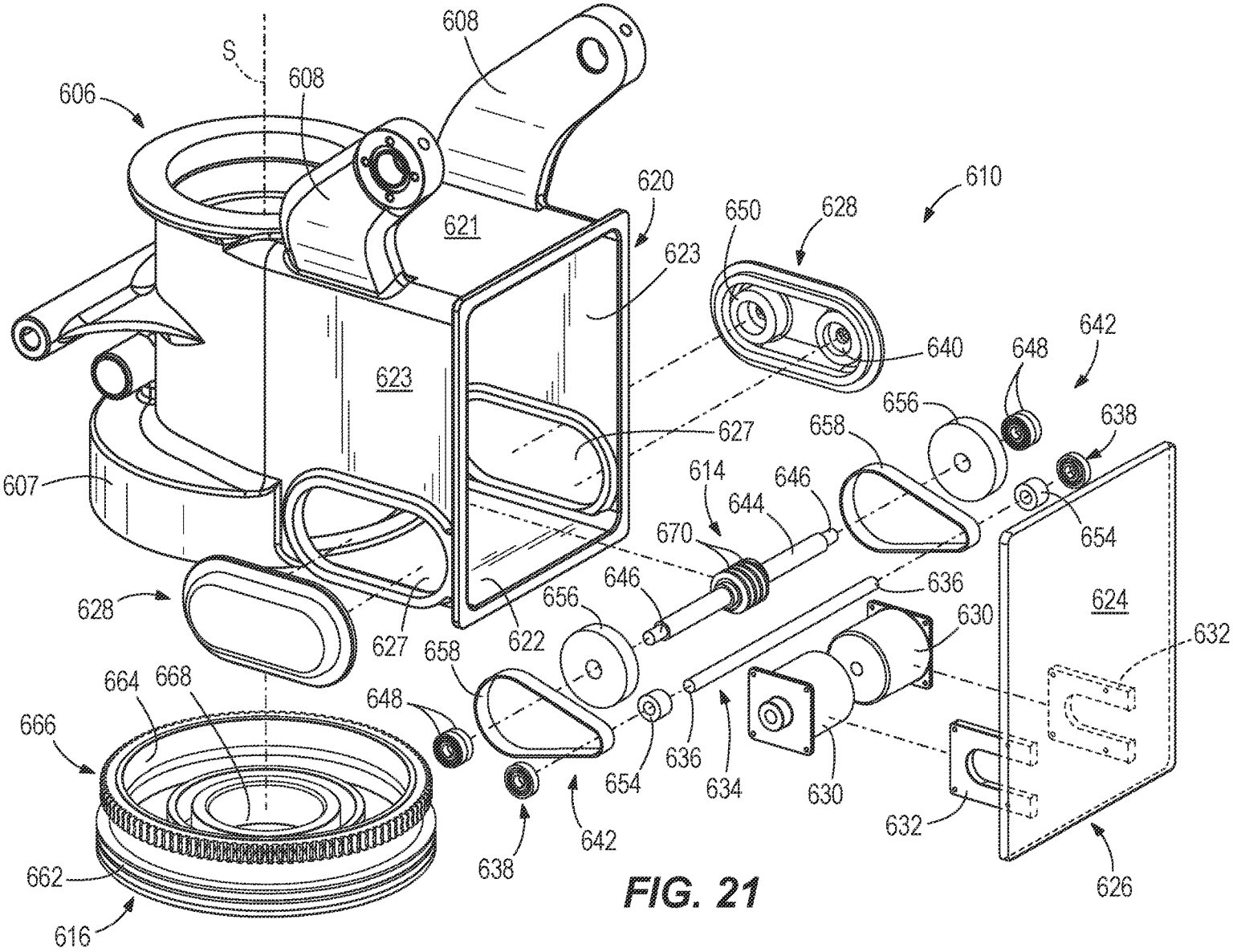
FIG. 21 is an exploded perspective view of the gearcase and steering actuator of the stern drive of FIG. 20.
Figure 22:
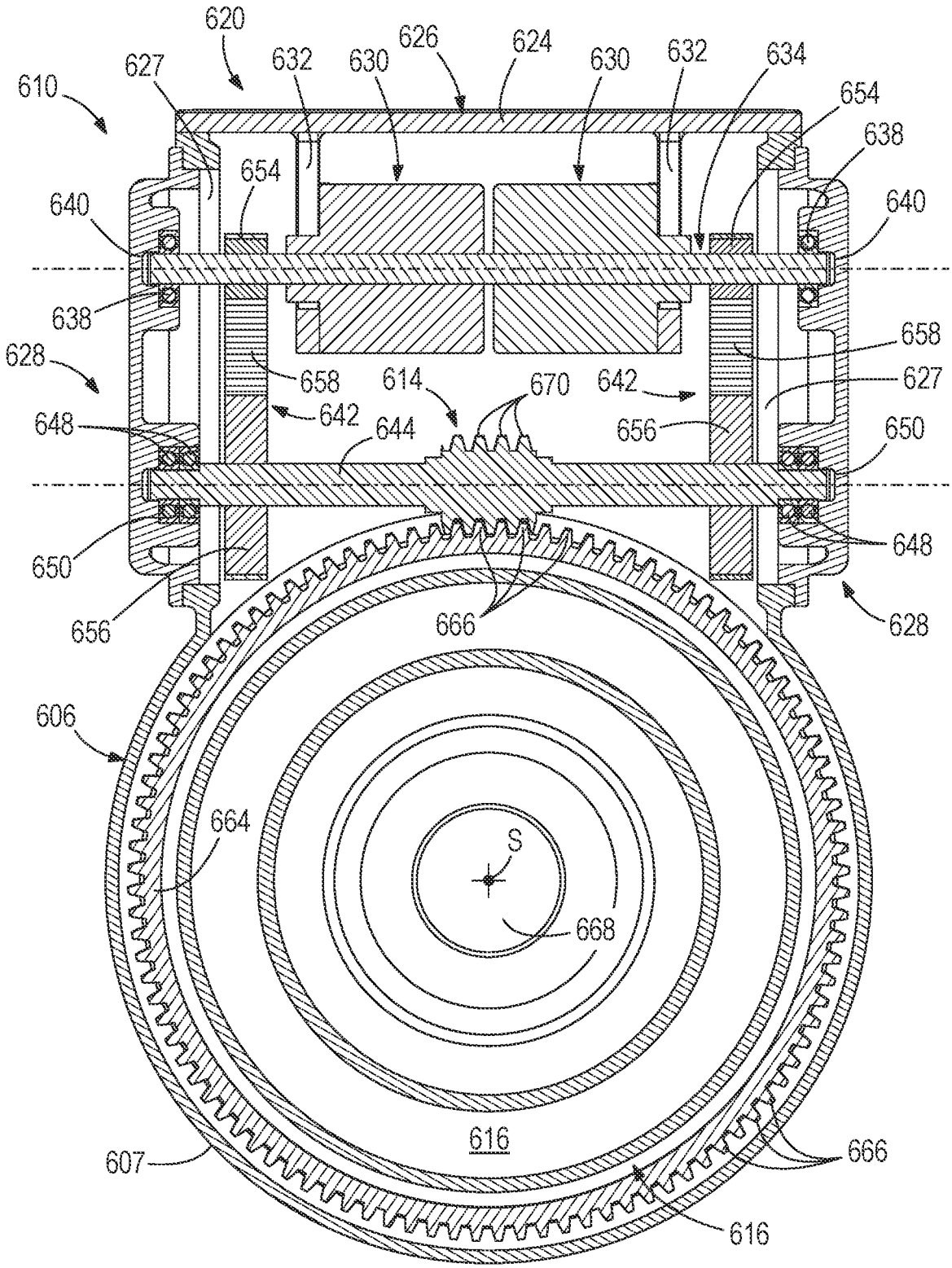
FIG. 22 is a view of section 22-22, taken in FIG. 20.

Referring to FIGS. 20-22, some embodiments of a stern drive 12 may be configured with a steering actuator 610 including at least one electric motor 630 that is operatively connected to the gearcase 26 by a worm drive gearset including a worm gear 614 and a ring gear 616 (i.e., a worm ring). The illustrated steering actuator 610 includes a steering enclosure 620 formed on a front side of the lower portion 606 of the gearcase 26. The steering enclosure 620 is generally rectangular and includes an upper wall 621, a lower wall 622, opposing lateral side walls 623, and a removable hatch 626 that includes a front wall 624 and can be secured to the forward edges of the upper, lower, and side walls 621, 622, 623 to enclose the steering enclosure 620. The lateral side walls 623 each include an access opening 627 that provides access to the interior of the steering enclosure 620 and a corresponding cover plate 628 configured to seal said access opening 627. In the illustrated embodiments, the drive assembly 20 is supported on the mounting assembly 16 by rigid mounting arms 608 that extend upward from the upper wall 621 of the steering enclosure 620 proximate the lateral sides thereof. Each mounting arm 608 is pivotably connected to the rigid mounting arms 104 of the rigid mounting plate 100, thereby suspending the drive assembly 20 from the mounting assembly 16. Some embodiments, however, may be configured with a different arrangement for supporting the drive assembly 20 on the mounting assembly 16.

Referring to FIGS. 21 and 22, the steering actuator 610 includes two electric motors 630 that are supported on corresponding motor mounting brackets 632 that extend from the front wall 624 of the steering enclosure 620. The illustrated first and second electric motors 630 are aligned with each other such that they share a single output shaft 634. Each electric motor 630 is independently operable to rotate the output shaft 634 and steer the gearcase 26. This may be useful, for example, in order to increase the output torque of the output shaft 634, and so that the steering actuator 610 has a redundant motor configuration. The output shaft 634 extends between opposite ends 636, which are supported by bearings 638 that are received in corresponding recesses 639 formed in the cover plates 628, thereby supporting the output shaft 634 between the opposing cover plates 628.

The worm gear 614 is mounted on a worm gear shaft 644 that extends between opposing ends 646 thereof. Each end 646 of the worm gear shaft 644 is supported by bearings 648 received in corresponding recesses 650 in the cover plates 628. The worm gear 614 is spaced longitudinally apart from the output shaft 634 and is coupled thereto by gearsets 642 positioned proximate the ends 636, 646 of the output shaft 634 and worm gear shaft 644. Thus, a first one of the electric motors 630 is operably coupled to the gearcase 26 by a first gearset 642 and a second one of the electric motors 630 is operably coupled to the gearcase 26 by a second gearset 642. In the illustrated embodiments, each gearset 642 is configured as a pulley linkage. Each pulley linkage includes a driven wheel 654 secured to the shared output shaft 634, an idle wheel 656 secured to the worm gear shaft 644, and a pulley band 658 that extends around and connects the driven wheel 654 to the idle wheel 656. When one or both of the electric motors 630 are controlled to rotate the output shaft 634, the driven wheels 654 pull on and advance the pulley band 658, thereby causing the idle wheels 656, the worm gear shaft 644, and the worm gear 614 to rotate.

With continued reference to FIGS. 21 and 22, the worm gear 614 is operatively connected to the gearcase 26 by the ring gear 616. The ring gear 616 has a circular base 662 that is configured to be coupled to the gearcase 26, an annular wall 664 extending upwards from the circular base 662, radially outward gear teeth 666 formed around the radially outer surface of the annular wall 664, and a through bore 668 extending through the center of the circular base 662. The ring gear 616 is rotatably received in a hub 607 of the lower housing portion 606 of the gearcase 26 such that the teeth 666 of the ring gear 616 are meshed with the teeth 670 of the worm gear 614 and the driveshaft 24 extends through the driveshaft. Thus, rotation of the output shaft 634 by the electric motors 630 causes the gearcase 26 to rotate about the steering axis S.

In order to steer the stern drive 12 with the steering actuator 610, an operator may use the input device to control one or both of the electric motors 630. To turn the marine vessel in the port direction, the electric motors 630 are powered to rotate the output shaft 634 in a first direction.

When the output shaft 634 is rotated, the pulley gearsets 642 at either end 636 of the output shaft 634 force the worm gear shaft 644 to rotate in the first direction. As the worm gear shaft 644 rotates, the teeth 670 of the worm gear 614 press against the teeth 666 of the ring gear 616 to rotate the ring gear 616 and gearcase 26 about the steering axis S into a starboard-facing orientation so that the thrust force generated by the propulsors 30 turns the marine vessel in the port direction. To turn the marine vessel in the starboard direction, the electric motors 630 are powered to rotate the output shaft 634 in a second direction. When the output shaft 634 is rotated, the pulley gearsets 642 at either end 636 of the output shaft 634 force the worm gear shaft 644 to rotate in the second direction. As the worm gear shaft 644 rotates, the teeth 670 of the worm gear 614 press against the teeth 666 of the ring gear 616 to rotate the ring gear 616 and gearcase 26 in an opposite direction about the steering axis S into a port-facing orientation so that the thrust force generated by the propulsors 30 turns the marine vessel in the starboard direction.

In some embodiments, the worm gear 614 and the ring gear 616 may be configured as a self-locking worm gearset. In the illustrated embodiments, for example, the worm gear 614 is engaged with the ring gear 616 via gear teeth 670 having a lead angle that causes the worm gear 614 to resist rotation of the ring gear 616 when the gearcase 26 is subjected to an external force. In some embodiments, the lead angle of the worm gear teeth 670 may be less than or equal to 5 degrees to achieve a self-locking configuration. Other embodiments, however, may be configured with a lead angle that is greater than 5 degrees. Further still, at least one other parameter of the worm gear 614 and/or the ring gear 616 (e.g., the material(s) of the gear(s) 614, 616, the coefficient of friction between the gears 614, 616, etc.) may be selected to achieve a self-locking worm gear configuration that resists back driving of the gearcase 26.

In the illustrated embodiments, the teeth 666 of the ring gear 616 extend 360 degrees around the annular wall 664 such that the steering actuator 610 can rotate the gearcase 26 360 degrees around the steering axis S without reversing the direction of rotation of the output shaft 634. Some embodiments, however, may only include gear teeth 666 extending around a portion of the annular wall 664 such that the gearcase 26 cannot be rotated a full 360 degrees.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples which occur to those skilled in the art. Such other examples are intended to be within the scope of the claims if they have features or structural elements which do not differ from the literal language of the claims, or if they include equivalent features or structural elements with insubstantial differences from the literal language of the claims.

What is claimed is:

1. A marine drive for propelling a marine vessel in water, the marine drive comprising:

a drive assembly including a driveshaft housing and a gearcase, the gearcase being rotatable relative to the driveshaft housing and configured to support a propulsor for generating a thrust force in the water;

a mounting assembly configured to mount the drive assembly to the marine vessel;

a pivot joint coupling the drive assembly to the mounting assembly and defining a trim axis about which the drive assembly is pivotable relative to the mounting assembly;

a steering actuator configured to rotate the gearcase relative to the driveshaft housing; and a pump configured to pump a hydraulic fluid to and/or from the steering actuator, said hydraulic fluid being conveyed through the pivot joint.

2. The marine drive according to claim 1, wherein the drive assembly includes an electric motor configured to power the propulsor.

3. The marine drive according to claim 1, wherein the steering actuator is coupled to the drive assembly and the pump is coupled to the mounting assembly.

4. The marine drive according to claim 1, wherein the pump is located on an opposite side of the mounting assembly relative to the steering actuator.

5. The marine drive according to claim 1, further comprising a series of fluid passages configured to convey said hydraulic fluid from the pump to the steering actuator through the mounting assembly, the pivot joint, and the drive assembly.

6. The marine drive according to claim 1, the mounting assembly including at least one mounting arm coupled to the drive assembly at the pivot joint, said hydraulic fluid being conveyed through the at least one mounting arm.

7. The marine drive according to claim 1, wherein the mounting assembly includes a port mounting arm and a starboard mounting arm, and wherein the hydraulic fluid is conveyed through the port mounting arm and through the starboard mounting arm.

8. The marine drive according to claim 1, the driveshaft housing including a mounting bracket coupled to the mounting assembly at the pivot joint, said hydraulic fluid being conveyed through the mounting bracket.

9. The marine drive according to claim 1, the pivot joint including a stationary member and a rotary member that is rotatable relative to the stationary member, said hydraulic fluid being conveyed through the stationary member and through the rotary member.

10. The marine drive according to claim 9, wherein the stationary member is part of the mounting assembly and wherein the rotary member is a part of the driveshaft housing.

11. The marine drive according to claim 9, further comprising a first fluid passage configured to convey said hydraulic fluid in the stationary member, a second fluid passage configured to convey said hydraulic fluid in the rotary member, and a chamber in the pivot joint, the chamber configured to convey said hydraulic fluid between the first fluid passage and the second fluid passage.

12. The marine drive according to claim 11, further comprising a third fluid passage that is fluidly coupled to the second fluid passage, the third fluid passage extending from the rotary member to the steering actuator.

13. The marine drive according to claim 9, wherein the rotary member includes a stem that is rotatable within a cavity in the stationary member.

14. The marine drive according to claim 13, wherein the stem includes a radial bore configured to convey said hydraulic fluid to an annular passage between the stem and the cavity in the stationary member.

15. The marine drive according to claim 14, further comprising a seal sealing the stem to an inner surface of the cavity.

16. The marine drive according to claim 1, wherein the steering actuator includes a hydraulic cylinder.

17. The marine drive according to claim 1, wherein the steering actuator includes a rack and kingpin, and wherein movement of the rack rotates the kingpin to rotate the gearcase relative to the driveshaft housing.

18. The marine drive according to claim 17, wherein the steering actuator includes a cylinder containing the rack, the rack being movable back and forth in the cylinder to rotate the gearcase relative to the driveshaft housing.

19. A marine drive for propelling a marine vessel, the marine drive comprising:

a drive assembly configured to support a propulsor for generating a thrust force in water, the drive assembly comprising a driveshaft housing and a gearcase suspended from the driveshaft housing;

a mounting assembly configured to couple the driveshaft housing to the marine vessel, wherein the drive assembly is trimmable relative to the mounting assembly about a trim joint;

a steering actuator configured to steer the gearcase relative to the driveshaft housing;

a pump configured to pump a hydraulic fluid to and/or from the steering actuator via the trim joint, wherein the hydraulic fluid is conveyed through the mounting assembly and through the driveshaft housing; and a port mounting arm and a starboard mounting arm which pivotally couple the mounting assembly to the driveshaft housing, wherein the hydraulic fluid is conveyed through the port mounting arm and through the starboard mounting arm.

20. The marine drive according to claim 19, wherein the port mounting arm and the starboard mounting arm extend from a first one of the driveshaft housing and the mounting assembly and are coupled to a second one of the driveshaft housing and the mounting assembly along the trim joint.

* * * * *